US011999532B2

(12) United States Patent
Katada

(10) Patent No.: US 11,999,532 B2
(45) Date of Patent: Jun. 4, 2024

(54) BAG BODY, AND MANUFACTURING METHOD AND MANUFACTURING DEVICE FOR BAG BODY

(71) Applicant: IDEMITSU UNITECH CO., LTD., Tokyo (JP)

(72) Inventor: Ryo Katada, Tokyo (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 234 days.

(21) Appl. No.: 16/647,113

(22) PCT Filed: Aug. 29, 2018

(86) PCT No.: PCT/JP2018/031876
§ 371 (c)(1),
(2) Date: Mar. 13, 2020

(87) PCT Pub. No.: WO2019/054180
PCT Pub. Date: Mar. 21, 2019

(65) Prior Publication Data

US 2020/0231339 A1 Jul. 23, 2020

(30) Foreign Application Priority Data

Sep. 14, 2017 (JP) ..... 2017-177179

(51) Int. Cl.
*B65D 33/25* (2006.01)

(52) U.S. Cl.
CPC ..... *B65D 33/25* (2013.01); *B65D 2251/02* (2013.01)

(58) Field of Classification Search
CPC .... B65D 33/25; B65D 2251/02; B65D 75/66; B65D 77/32
(Continued)

(56) References Cited

U.S. PATENT DOCUMENTS 5,836,697 A * 11/1998 Chiesa ..... B65D 75/66 383/66
7,887,653 B2 2/2011 Goto et al.
(Continued)

FOREIGN PATENT DOCUMENTS

CN 101160206 A 4/2008
CN 108024600 A 5/2018
(Continued)

OTHER PUBLICATIONS

Machine translation of WO-2017047573-A1.*
(Continued)

*Primary Examiner* — Jes F Pascua
(74) *Attorney, Agent, or Firm* — Millen, White, Zelano & Branigan, P.C.; Ryan R. Pool

(57) ABSTRACT

A bag includes: a film defining a containable space and a first area and a second area both facing the containable space; an elongated tearing guide piece directly or indirectly bonded to the first area; an elongated belt-shaped base disposed between the tearing guide piece and the second area and along the tearing guide piece; a tab defined by a cut portion penetrating through the first area of the film, the tearing guide piece and the belt-shaped base; and a surrounding seal area intersecting the tearing guide piece in a width direction, the surrounding seal area bonding the first area and the second area to define an area surrounding the tab.

20 Claims, 21 Drawing Sheets

(58) Field of Classification Search
USPC ..... 383/205
See application file for complete search history.

(56) References Cited

U.S. PATENT DOCUMENTS

| | | | | |
|---|---|---|---|---|
| 2006/0104550 | A1* | 5/2006 | Kuge | B65D 75/66 383/66 |
| 2009/0050254 | A1 | 2/2009 | Goto et al. | |
| 2012/0046151 | A1 | 2/2012 | Yeager | |
| 2018/0251268 | A1* | 9/2018 | Todaka | B65D 33/2533 |
| 2021/0009316 | A1 | 1/2021 | Todaka et al. | |

FOREIGN PATENT DOCUMENTS

| | | | | | |
|---|---|---|---|---|---|
| JP | H09207948 | A | * | 8/1997 | |
| JP | 11-510461 | A | | 9/1999 | |
| JP | 2002337890 | A | * | 11/2002 | |
| JP | 2004276925 | A | * | 10/2004 | |
| JP | 2005263300 | A | * | 9/2005 | |
| JP | 2009051556 | A | * | 3/2009 | |
| JP | 2013147288 | A | * | 8/2013 | |
| JP | 2014-114035 | A | | 6/2014 | |
| JP | 2014113263 | A | * | 6/2014 | |
| JP | 2014114035 | A | * | 6/2014 | |
| JP | 2014114035 | A | | 6/2014 | |
| JP | 6113339 | B1 | * | 4/2017 | B65D 33/00 |
| WO | 2006/112448 | A1 | | 10/2006 | |
| WO | 06112448 | A1 | | 10/2006 | |
| WO | 2016/163349 | A1 | | 10/2016 | |
| WO | 16163349 | A1 | | 10/2016 | |
| WO | 2017/047573 | A1 | | 3/2017 | |
| WO | 17047573 | A1 | | 3/2017 | |
| WO | WO-2017047573 | A1 | * | 3/2017 | A44B 19/16 |

OTHER PUBLICATIONS

Machine translation of JP-2014113263-A.*
Machine translation of JP-6113339-B1.*
Machine translation of WIPO Document No. 2016/163349 A1.*
Machine translation of JP-2002337890-A.*
Machine translation of JP-2004276925-A.*
Machine translation of JP-H09207948-A.*
International preliminary report on Patentability PCT/JP2018/031876 dated Mar. 17, 2020 (pp. 1-6).
Office Action issued in corresponding Chinese patent application No. 201880059771.4 dated Jul. 30, 2021 (pp. 1-12).
International Search Report dated Oct. 9, 2018 issued in corresponding PCT/JP2018/031876 application (2 pages).
English Abstract of WO 2006/112448 A1 published Oct. 26, 2006.
English Abstract of JP 2014-114035 A published Jun. 26, 2014.
English Abstract of WO 2016/163349 A1 published Oct. 13, 2016.
English Abstract of WO 2017/047573 A1 published Mar. 23, 2017.

* cited by examiner

BAG BODY, AND MANUFACTURING METHOD AND MANUFACTURING DEVICE FOR BAG BODY

TECHNICAL FIELD

The present invention relates to a bag, a manufacturing method of the bag and a manufacturing machine of the bag.

BACKGROUND ART

Various typically known bags for packaging medicines and foods include a bag body made of a film and a zipper tape (fastener) bonded to the bag body. For instance, Patent Literature 1 discloses a bag made of a film and provided with a resealable fastener bonded to a wall of the bag. The film is manufactured by: feeding a fastener material from a coil; positioning the fastener; cutting the fastener; and attaching the fastener to the film, thus attaching a plurality of fasteners to the film. The bag is produced by folding and overlapping both ends of the film attached with the fasteners to form a seal, and subsequently forming a top seal and a bottom seal for each bag.

The bag disclosed in Patent Literature 1 is provided with a pullout plug that allows the bag to be easily unsealed. The pullout plug includes an exposed tab (i.e. end portion) connected to the pullout plug. A user can pinch and pull the end portion to form an opening in a front wall covering the resealable fastener by removing the pullout plug. According to the disclosure of Patent Literature 1, the bag is provided by folding the film to reduce the number of sealed portions and the resealable fastener can be attached to the bag in a simple process. Further, an opening can be easily formed in the bag using the pullout plug.

CITATION LIST

Patent Literature(S)

Patent Literature 1: JP 11-510461 A

SUMMARY OF THE INVENTION

Problem(s) to be Solved by the Invention

In unsealing the bag disclosed in Patent Literature 1, the end portion of the pullout plug has to be raised in some way from the front wall of the bag in order to allow a user to pinch and pull the end portion of the pullout plug. However, Patent Literature 1 teaches nothing on the method for raising the end portion. Patent Literature 1 discloses that the pullout plug is formed of a plurality of holes in the front wall of the bag. However, sealability of the bag could be a problem when the holes are formed in the bag. Patent Literature 1 also discloses nothing on the above.

An object of the invention is to provide a new and improved bag capable of keeping sealability of the bag and allowing easy formation of an opening in unsealing the bag, a manufacturing method of the bag, and a manufacturing machine of the bag.

Means for Solving the Problem(s)

A bag according to an aspect of the invention includes: a film defining a containable space, the film including a first area and a second area both facing the containable space; an elongated tearing guide piece directly or indirectly bonded to the first area; an elongated belt-shaped base disposed between the tearing guide piece and the second area along the tearing guide piece; a tab defined by a cut portion penetrating through the first area of the film, the tearing guide piece, and the belt-shaped base; and a surrounding seal area intersecting the tearing guide piece in a width direction, the surrounding seal area bonding the first area and the second area to define an area surrounding the tab.

According to the above aspect of the invention, an opening can be easily formed in the bag by tearing the film with the elongated tearing guide piece. Since a user can raise and pinch the tab and pull the tearing guide piece starting from the tab, the formation of the opening can be further facilitated. Meanwhile, the tab is surrounded by the surrounding seal area defined between the first area and second area of the film, so that the sealability of the bag can be maintained.

In the bag according to the above aspect of the invention, the film may define the containable space by being folded at both side portions of the bag, the first area and the second area may be mutually opposed across the containable space, and a bonding portion, at which ends of the film are bonded, may be formed on the second area.

Alternatively, in the bag according to the above aspect of the invention, the film may include a portion interfolded toward the containable space at at least one of side portions of the bag, and at least one of the first area and the second area may define the interfolded portion.

Further, in the bag according to the above aspect of the invention, at least one of side portions of the bag may be formed by folding the film and the at least one of the side portions may be spaced apart from a longitudinal end of the tearing guide piece and a longitudinal end of the belt-shaped base.

Further, in the bag according to the above aspect of the invention, the surrounding seal area may be adjacent to the at least one of side portions of the bag defined by folding the film, the surrounding seal area surrounding the tab in cooperation with the at least one of the side portions.

Alternatively, the surrounding seal area may surround the tab by itself.

The bag according to the above aspect of the invention may further include: an opposite base disposed along and opposite the belt-shaped base, the opposite base being bonded to the first area; and a pair of engagement portions protruding from respective ones of the belt-shaped base and the opposite base, the pair of engagement portions being engageable with each other.

In this case, the tearing guide piece may be bonded to the first area through the opposite base.

Further, the bag according to the above aspect of the invention may further include a cut portion formed at a position different from the tab, the cut portion penetrating through the first area of the film and the tearing guide piece without penetrating through the belt-shaped base.

A manufacturing method of a bag according to another aspect of the invention includes: transferring a film; directly or indirectly bonding an elongated tearing guide piece and an elongated belt-shaped base overlaid on the tearing guide piece with the film; forming a cut portion penetrating through the film, the tearing guide piece, and the belt-shaped base to form a tab; defining a containable space, a first area bonded with the tearing guide piece and the belt-shaped base and facing the containable space, and a second area facing the containable space as well as the first area; forming a first bonding portion at which both ends of the film in the width direction are bonded; forming a second bonding portion extending in the width direction of the film; cutting the film in the width direction at a part near the second bonding portion; and forming a surrounding seal area intersecting the tearing guide piece in the width direction, the surrounding seal area bonding the first area and the second area in an area surrounding the tab.

In the manufacturing method of a bag according to the above aspect of the invention, in forming the first area and the second area, the film may be folded at least at two parts in the width direction, and the first bonding portion may be formed in the second area.

Further, the manufacturing method of a bag according to the above aspect of the invention may further include integrally molding the tearing guide piece and the belt-shaped base.

Further, the manufacturing method of a bag according to the above aspect of the invention may further include forming a second cut portion at a position different from the tab, the second cut portion penetrating through the film and the tearing guide piece without penetrating through the belt-shaped base.

A manufacturing machine of a bag, according to still another aspect of the invention includes: an elongated-member bonding unit configured to directly or indirectly bond an elongated tearing guide piece and an elongated belt-shaped base overlaid on the tearing guide piece with a film; a tab former configured to form a cut portion penetrating through the film, the tearing guide piece, and the belt-shaped base to form a tab; a bag former configured to define a containable space, a first area bonded with the tearing guide piece and the belt-shaped base and facing the containable space, and a second area facing the containable space as well as the first area; a first bonding-portion former configured to form a first bonding portion at which both ends of the film in the width direction are bonded; a second bonding-portion former configured to form a second bonding portion extending in the width direction of the film; a cutter configured to cut the film in the width direction at a part near the second bonding portion; and a third bonding-portion former configured to form a surrounding seal area intersecting the tearing guide piece in the width direction, the surrounding seal area bonding the first area and the second area to define an area surrounding the tab.

In the manufacturing machine of a bag according to the above aspect of the invention, the bag former may be configured to fold the film at least at two parts in the width direction, and the first bonding-portion former may be configured to form the first bonding portion in the second area.

The manufacturing machine of a bag according to the above aspect of the invention may further include a molding machine configured to integrally mold the tearing guide piece and the belt-shaped base.

The manufacturing machine of a bag according to the above aspect of the invention may further include a cut-portion former configured to form a second cut portion at a position different from the tab, the second cut portion penetrating through the film and the tearing guide piece without penetrating through the belt-shaped base.

BRIEF DESCRIPTION OF DRAWING(S)

DESCRIPTION OF EMBODIMENT(S)

Figure 1:
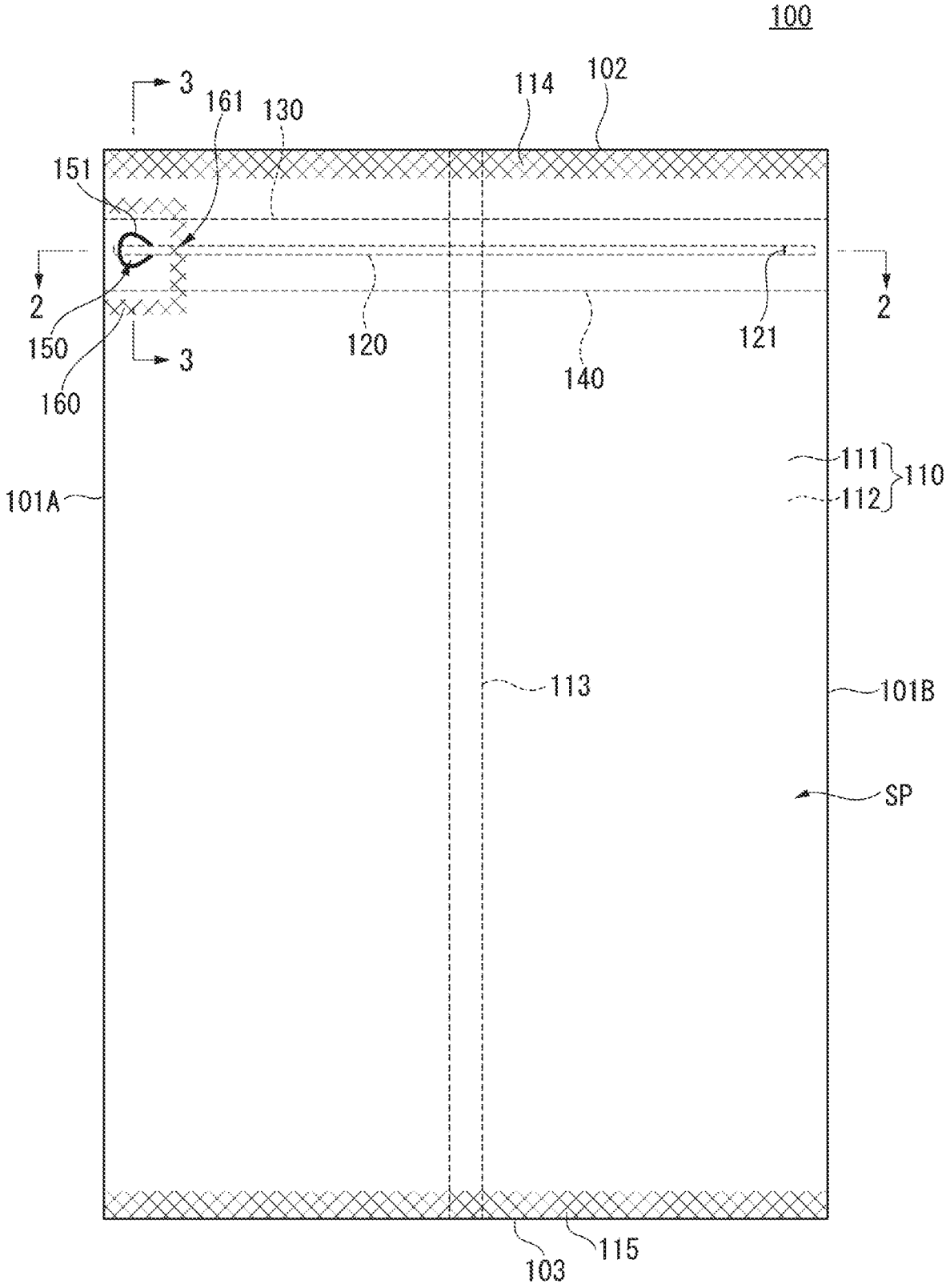
FIG. 1 is a front elevational view showing a bag according to a first exemplary embodiment of the invention.

Preferable exemplary embodiment(s) of the invention will be described below with reference to attached drawings. It should be noted that components having substantially the same functions will be denoted by the same reference numerals herein and in the drawings and duplicated description therefor will be omitted herein.

Bag According to First Exemplary Embodiment

Figure 2:
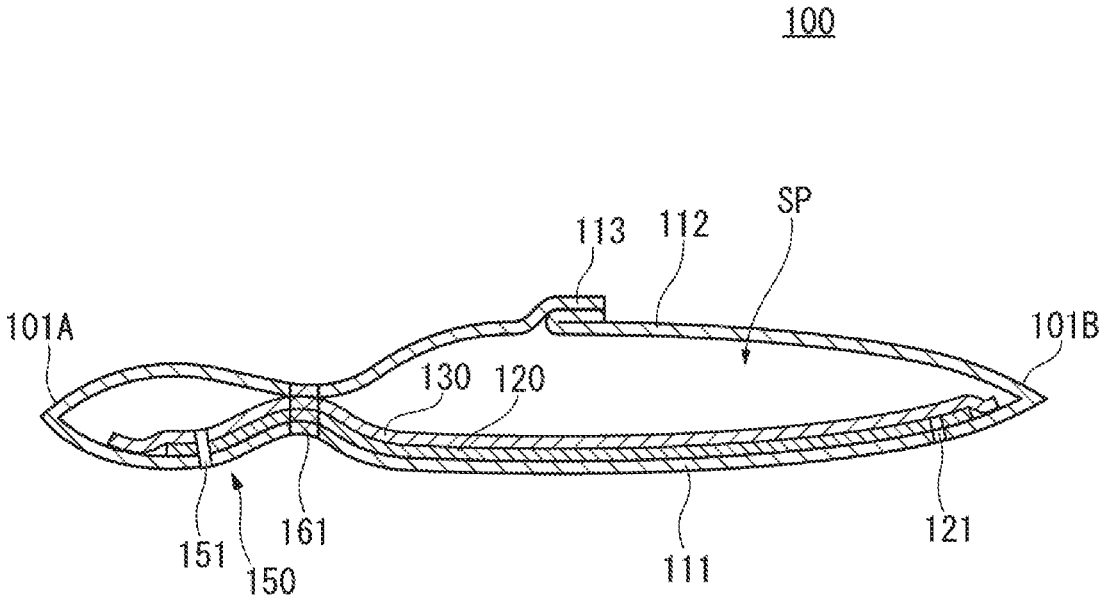
FIG. 2 is a cross sectional view of the bag shown in FIG. 1 taken along 2-2 line.
Figure 3:
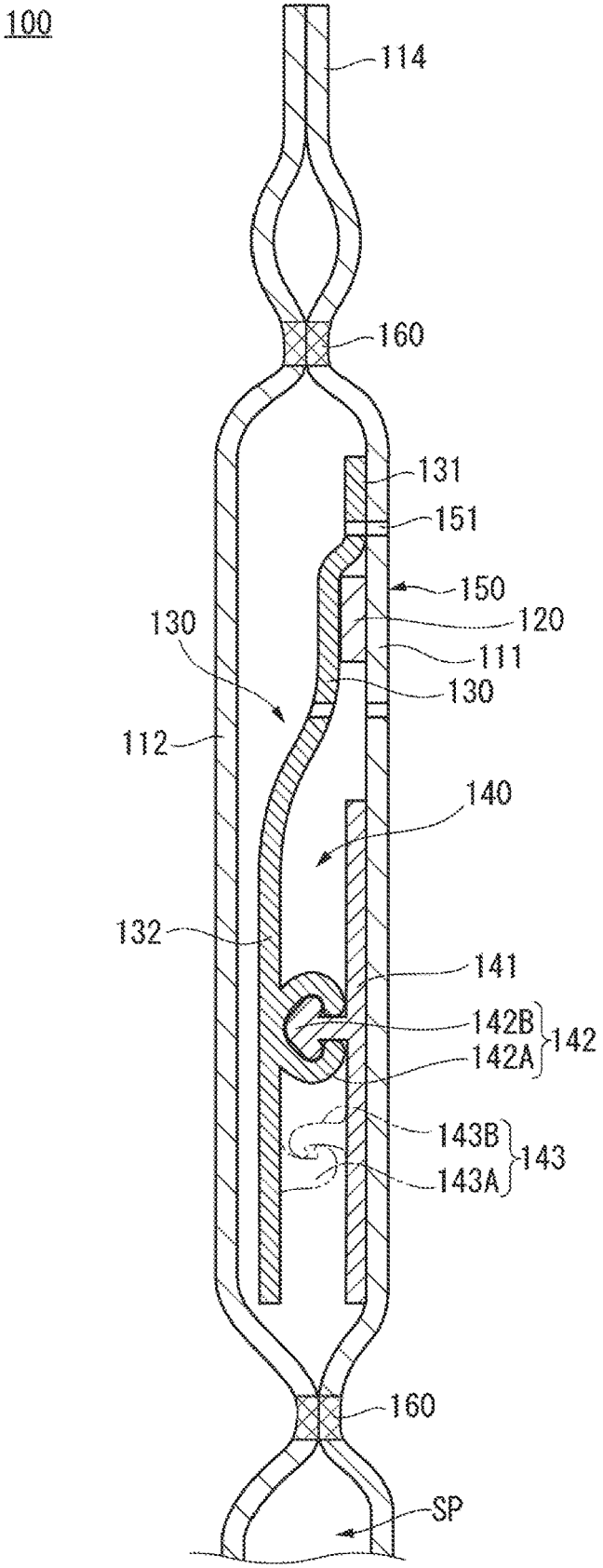
FIG. 3 is a cross sectional view of the bag shown in FIG. 1 taken along 3-3 line.
Figure 4:
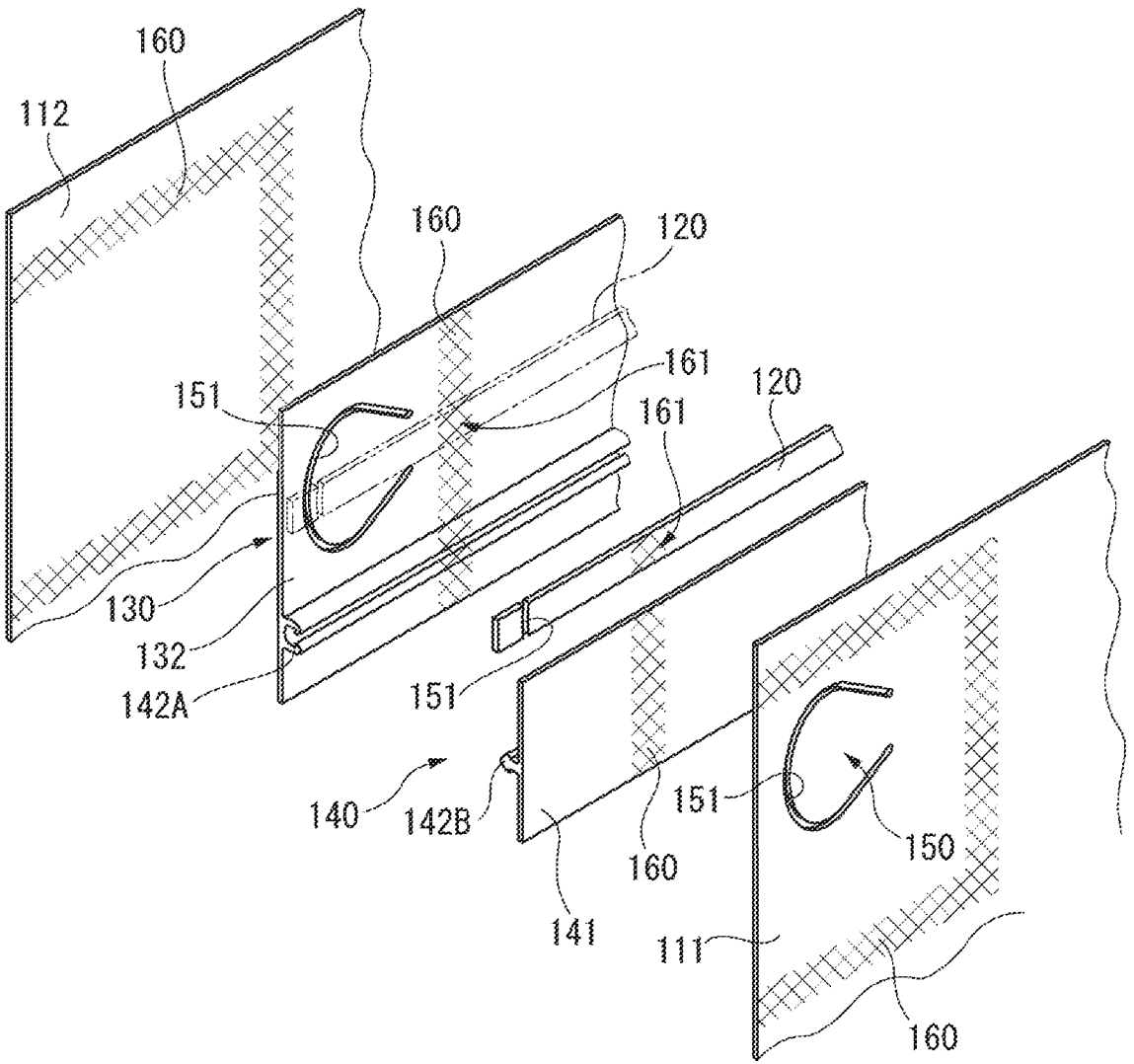
FIG. 4 is an exploded perspective view of a portion including a tab formed in the bag shown in FIG. 1.
Figure 5:
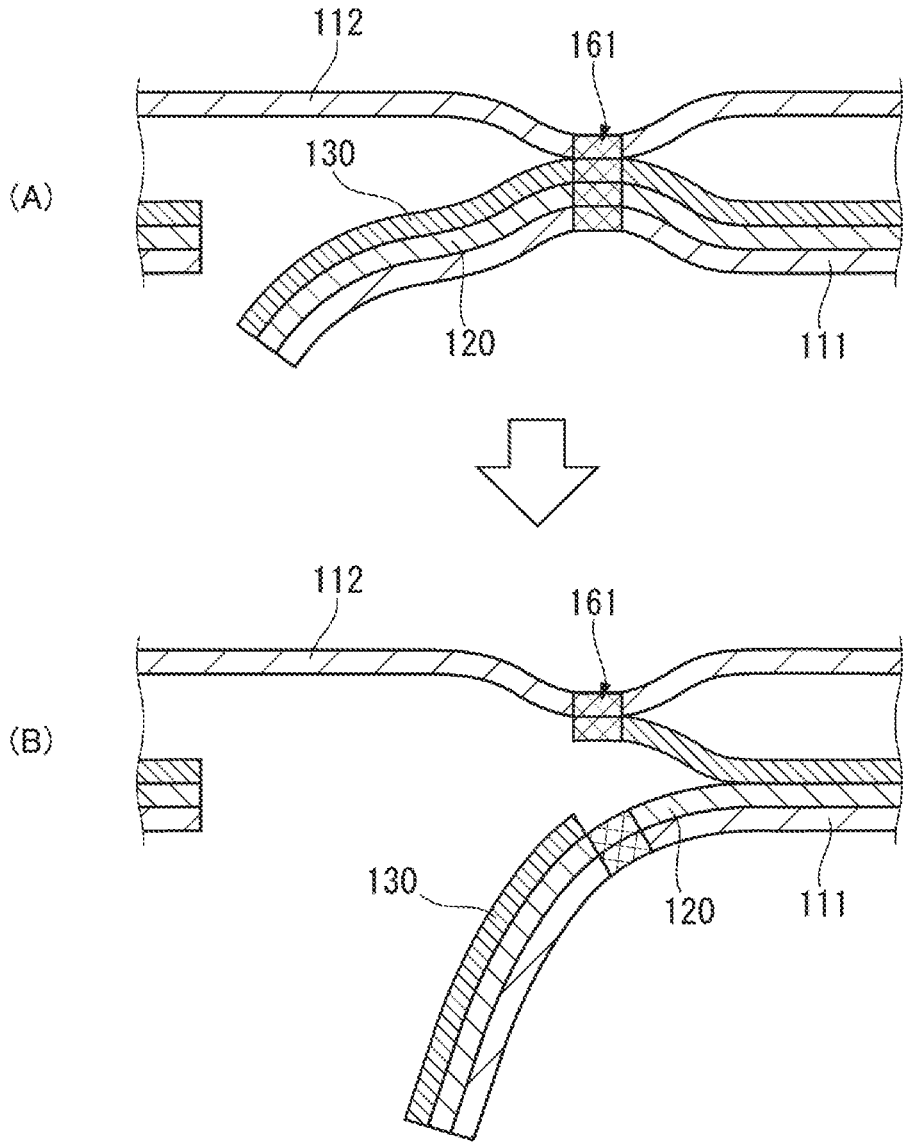
FIG. 5 illustrates an effect of a surrounding seal area in the first exemplary embodiment of the invention.

Initially, an arrangement of a bag according to a first exemplary embodiment of the invention will be described below with reference to FIGS. 1 to 5. FIG. 1 is a front elevational view showing a bag according to the first exemplary embodiment. FIG. 2 is a cross sectional view of the bag shown in FIG. 1 taken along 2-2 line. FIG. 3 is a cross sectional view of the bag shown in FIG. 1 taken along 3-3 line. FIG. 4 is an exploded perspective view of a portion including a tab formed in the bag shown in FIG. 1. FIG. 5 illustrates an effect of a surrounding seal area in the first exemplary embodiment.

As shown in FIG. 1, a bag 100 includes a film 110, a tearing guide piece 120, a belt-shaped base 130, a zipper tape 140, a tab 150, and a surrounding seal area 160. These components will be detailed below.

It should be noted that the side shown in FIG. 1 and a lower side in FIG. 2 will be referred to as a "front side" of the bag and an upper side in FIG. 2 will be referred to as a "rear side" of the bag. However, the terms "front side" and "rear side" are used merely for simply representing a positional relationship between components of the bag. The same applies to a "top portion," "a side portion," and a "bottom portion" of the bag. Accordingly, these terms should not be construed to limit an orientation of the bag at the time of production, during distribution, and in use.

The film 110 includes a first area 111 at the front side of the bag 100 and a second area 112 at the rear side of the bag 100. As shown in FIG. 2, the first area 111 and the second area 112 are defined by folding the film 110 at both side portions 101A, 101B of the bag 100. Ends of the folded film 110 are bonded at a seal portion 113 substantially at the center of the second area 112. It should be noted that the seal portion 113, which in the illustrated example is a so-called fin-seal at which parts of the same side of the film 110 are bonded, may be a so-called envelop seal at which opposite sides of the film 110 are bonded. The bag 100 has a containable space SP defined between the mutually facing first area 111 and the second area 112 of the film 110. The containable space SP is sealed by seal portions 114, 115 formed between the first area 111 and the second area 112 at a top portion 102 and a bottom portion 103 of the bag 100. It should be noted that the seal portions are each an example of a bonding portion.

The above-described film 110 is made of, for instance, a thermoplastic resin. More specifically, the film 110 may be made of LDPE (Low-Density PolyEthylene), LLDPE (Linear Low-Density PolyEthylene), or PP (PolyPropylene). PP may be HPP (Homo PolyPropylene), RPP (Random PolyPropylene), or BPP (Block PolyPropylene).

The tearing guide piece 120, which is an elongated member bonded to the first area 111 of the film 110, extends along the top portion 102 of the bag 100. As described later, a user can pinch the tearing guide piece 120 at the tab 150. The user can easily form an opening in the bag 100 by pulling the tearing guide piece 120 at the tab 150 and by tearing the film 110 using the tearing guide piece 120.

It should be noted that, though the tearing guide piece 120 is described herein as a component bonded to the first area 111 of the film 110, the tearing guide piece 120 is not necessarily directly bonded to the first area 111 as in the example shown in FIG. 3. For instance, a belt-shaped sheet or the like may be interposed between the tearing guide piece 120 and the first area 111, whereby the tearing guide piece 120 is indirectly bonded to the first area 111.

A cut portion 121 penetrating through the film 110 of the first area 111 and the tearing guide piece 120 is provided at a position of the bag 100 different from the tab 150, more specifically, near a longitudinal end of the tearing guide piece 120 opposite the tab 150. The cut portion 121 defines an end point of cutting of the film 110 by the tearing guide piece 120, so that the tearing guide piece 120 can be easily removed after forming an opening in the bag 100. It should be noted that, for instance, with use of an easily-tearable film 110, the cutting of the film 110 by the tearing guide piece 120 can be terminated at a desired position even without the cut portion 121. Accordingly, the cut portion 121 is not requisite in the invention. The cross sectional profile of the tearing guide piece 120, which is rectangular in the illustrated example, may be designed otherwise (e.g. triangular and semi-circular). Alternatively, the tearing guide piece 120 may be a string having an irregular cross sectional profile in the longitudinal direction.

The belt-shaped base 130 is an elongated member disposed along the tearing guide piece 120 between the tearing guide piece 120 and the second area 112 of the film 110. The tearing guide piece 120 and the belt-shaped base 130 may be integrally molded through, for instance, co-extrusion, or may be separately molded and subsequently bonded. In any case, the tearing guide piece 120 and the belt-shaped base 130 are made of a pair of incompatible resins (as detailed later), so that interfacial peeling occurs between the belt-shaped base 130 and the tearing guide piece 120 when an opening is formed by the tearing guide piece 120. As shown in FIG. 3, the belt-shaped base 130, which is wider than the tearing guide piece 120 in the first exemplary embodiment, has a first end 131 bonded to the first area 111 of the film 110 near the top portion 102 of the bag 100 and a second end defining a part of the zipper tape 140 described later. It should be noted that the cut portion 121 formed in the tearing guide piece 120 does not penetrate through the belt-shaped base 130.

An example of the above pair of incompatible resins for forming the tearing guide piece 120 and the belt-shaped base 130 is a pair of low-density polyethylene resin and a random polypropylene resin. In this case, one of the tearing guide piece 120 and the belt-shaped base 130 is made of the low-density polyethylene resin and the other is made of the random polypropylene resin. Examples of the "low-density polypropylene resin/random polypropylene resin" include LDPE (Low-Density PolyEthylene)/RPP (Random PolyPropylene), LLDPE (Linear Low-Density PolyEthylene)/RPP (partially including m-LL), LDPE/HPP (Homo PolyPropylene), LLDPE/HPP (partially including m-LL), LDPE/PS (PolyStyrene), LLDPE/PS (partially including m-LL), RPP/PS, HPP/PS, LDPE/PET (PolyEthylene Terephthalate), LLDPE/PET, RPP/PET, HPP/PET, PS/PET, LDPE/Ny (Nylon), LLDPE/Ny, RPP/Ny, HPP/Ny, and PS/Ny.

Further, as shown in FIG. 1, side portions 101A, 101B of the bag 100 formed by folding the film 110 are spaced apart from longitudinal ends of the tearing guide piece 120, belt-shaped base 130, and the zipper tape 140 in the first exemplary embodiment. This is because, as described later, the tearing guide piece 120, the belt-shaped base 130, and the zipper tape 140 are cut into a predetermined length and then bonded to the film 110 before the film 110 is folded during the manufacturing process of the bag 100.

The zipper tape 140 includes a tape base 132 as a part of the belt-shaped base 130, an opposite base 141 disposed along the belt-shaped base 130 and opposite the tape base 132 of the belt-shaped base 130, and an engagement portion 142. These components of the zipper tape 140 are also elongated members extending along the top portion 102 of the bag 100 in the same manner as the tearing guide piece 120 and the belt-shaped base 130. The opposite base 141, which is disposed opposite the tape base 132, is bonded to the first area 111 of the film 110. The engagement portion 142 is a pair of engagement portions including a female portion 142A protruding from the tape base 132 and a male portion 142B protruding from the opposite base 141, the female portion 142A and the male portion 142B being engaged with each other. It should be noted that the above positional relationships between the tape base 132 and the opposite base 141 and between the female portion 142A and the male portion 142B may be reversed. After forming an opening in the bag 100 by the tearing guide piece 120, the engagement portion 142 of the zipper tape 140 is engaged to reseal the containable space SP.

It should be noted that the opposite base 141, which is described herein as a component facing the belt-shaped base 130, does not necessarily face the entire surface of the belt-shaped base 130. In examples shown in FIGS. 3 and 4, the belt-shaped base 130 is wider than the opposite base 141 in the width direction, and thus the opposite base 141 faces only a part of the belt-shaped base 130 in the width direction. The opposite base 141 is disposed to face the entire surface of the belt-shaped base 130 in some other embodiments.

The zipper tape 140 may include a hook-shaped engagement portion 143 as shown in chain lines in FIG. 3. The hook-shaped engagement portion 143 includes a first hook 143A protruding from the tape base 132 and a second hook 143B protruding from the opposite base 141. As shown in FIG. 3, the first hook 143A is a hook protruding toward the top portion 102 of the bag 100 and the second hook 143B is a hook protruding toward the bottom portion 103 of the bag 100. For instance, when an internal pressure acts on the zipper tape 140 due to expansion of the contents after the containable space SP is resealed by the zipper tape 140, since the tape base 132 and the opposite base 141 are both bonded to the first area 111 of the film 110, a shear force along the surface of the first area 111 acts on the hook-shaped engagement portion 143. The shear force acts in a direction for mutually engaging the first hook 143A and the second hook 143B. Accordingly, the hook-shaped engagement portion 143 can be kept engaged against the internal pressure. In contrast, in unsealing the bag 100, the hook-shaped engagement portion 143 can be easily disengaged when a user applies a force for separating the tape base 132 and the opposite base 141 in directions perpendicular to the surface of the first area 111.

In the illustrated example, the zipper tape 140 includes the engagement portion 142. The zipper tape 140 may additionally include the hook-shaped engagement portion 143. In some other embodiments, the zipper tape 140 includes the hook-shaped engagement portion 143 in place of the engagement portion 142. In still other embodiments, the zipper tape 140 includes a plurality of the engagement portions 142, and/or a plurality of the hook-shaped engagement portions 143. It should be noted that the zipper tape 140 may include engagement portions of various known configurations in addition to the illustrated exemplary engagement portion 142 and hook-shaped engagement portion 143. It should be noted that the tape base 132 of the zipper tape 140 is made of the same resin as that of the belt-shaped base 130. Other portions may be made of the same resin as that of the tape base 132 or may be made of other types of resins known as a material for the zipper tape.

As shown in FIG. 4, the tab 150 is defined near a first longitudinal end of the tearing guide piece 120 by a cut portion 151 penetrating through the first area 111 of the film 110, the tearing guide piece 120, and the belt-shaped base 130. In the illustrated example, the cut portion 151 has a horse-shoe profile in a plan view, an open end of the horse-shoe profile being oriented in a direction for the tearing guide piece 120 to form the opening. The tab 150, which is defined by the cut portion 151 of the above profile, allows the user to pinch the tab 150 after raising the tab 150 toward the front side of the bag 100, and to pull the tearing guide piece 120 starting from the tab 150. In other words, the formation of the tab 150 further facilitates creation of the opening in the bag 100 with the use of the tearing guide piece 120. The profile of the cut portion 151 in a plan view may be designed in any manner as long as the above-described tab 150 is formable. For instance, the cut portion 151 has C-shaped profile, U-shaped profile, circular profile or the like in a plan view in some other embodiments.

As shown in FIGS. 1 and 4, the surrounding seal area 160, which surrounds the tab 150 and intersects the tearing guide piece 120 in the width direction, is formed between the first area 111 and the second area 112 of the film 110. In the example shown in FIG. 1, the surrounding seal area 160 is adjacent to the side portion 101A of the bag 100 defined by folding the film 110 and has a U-shaped profile in a plan view with a side near the side portion 101A being opened. The thus located and defined surrounding seal area 160 surrounds the tab 150 in cooperation with the side portion 101A of the bag 100. The phrase that the "surrounding seal area 160 surrounds the tab 150 in cooperation with the side portion (or other seal portion in other examples) of the bag" means that the surrounding seal area 160 defines a part of the border around the tab 150 and the side portion (or other seal portion) of the bag defines another part of the border around the tab 150, thus surrounding the entirety of the tab 150.

A space, which is defined in an area surrounding the tab 150 by the surrounding seal area 160 and located between the first area 111 and the second area 112 of the film 110, is spatially separated from the containable space SP partitioned by the surrounding seal area 160. Accordingly, even when the tab 150 is defined by the cut portion 151 penetrating through the first area 111 of the film 110 to the belt-shaped base 130, the containable space SP is not in communication with an outer space of the bag 100, maintaining sealability of the containable space SP.

As described above, the surrounding seal area 160 surrounds the tab 150 in cooperation with the side portion 101A of the bag 100 in the first exemplary embodiment. In other words, the first area 111 and the second area 112 are not bonded at the portion extending along the side portion 101A of the bag 100 in the surrounding seal area 160 of the first exemplary embodiment. However, since the film 110 is folded at the side portion 101A, the space surrounding the tab 150 and defined between the first area 111 and the second area 112 is spatially separated from the containable space SP, so that the sealability of the containable space SP can be maintained. As described above, the first area and the second area are not necessarily bonded by the surrounding seal area entirely along the area surrounding the tab but may be partially not bonded in the exemplary embodiments of the invention. The sealability of the containable space can be also maintained in such an arrangement by surrounding the tab in cooperation with the folding of the film and other seal portion(s).

At an intersection 161 defined at a part of the surrounding seal area 160 intersecting the tearing guide piece 120 in the width direction, adjacent ones of the first area 111 of the film 110, the tearing guide piece 120, the belt-shaped base 130, and the second area 112 of the film 110 are mutually bonded. As described above, the tearing guide piece 120 and the belt-shaped base 130 are made of a pair of incompatible resins. Accordingly, even after the above components are bonded through, for instance, heat-seal or ultrasonic seal, interfacial peeling can be easily caused between the tearing guide piece 120 and the belt-shaped base 130. As a result, as described below with reference to FIG. 5, in forming the opening by the tearing guide piece 120, the tearing guide piece 120 and the belt-shaped base 130 are pulled starting from the tab 150 so that the belt-shaped base 130 is cut at the intersection 161 and the tearing guide piece 120 separated from the belt-shaped base 130 tears the film 110 beyond the intersection 161.

FIG. 5(A) shows the tearing guide piece 120 and the belt-shaped base 130, which have been pulled starting from the tab 150 and have not been peeled to reach the intersection 161. As illustrated, the cut portion 151 defining the tab 150 does not penetrate through to the second area 112 of the film 110. Accordingly, the first area 111 of the film 110, the tearing guide piece 120, and the belt-shaped base 130 are pulled when a user pinches the tab 150. While being pulled together with the tearing guide piece 120, the belt-shaped base 130 is torn in the longitudinal direction along a part corresponding to an extension of the cut portion 151.

In contrast, FIG. 5(B) shows the tearing guide piece 120 and the belt-shaped base 130, which have been pulled to reach the intersection 161. As described above, mutually adjacent ones of the tearing guide piece 120 and the belt-shaped base 130 and the belt-shaped base 130 and the second area 112 of the film 110 are bonded at the intersection 161. As described above, since the interfacial peeling, which can easily occur between the tearing guide piece 120 and the belt-shaped base 130, does not easily occur between the belt-shaped base 130 and the second area 112 of the film 110, the belt-shaped base 130 is more rigidly bonded to the second area 112 of the film 110 at the intersection 161. As a result, the belt-shaped base 130 bonded to the second area 112 of the film 110 is torn at the intersection 161, failing to follow the tearing guide piece 120 pulled beyond the intersection 161.

Due to the above effect of the surrounding seal area 160, the belt-shaped base 130, which is pulled together with the tearing guide piece 120 at the tab 150, is torn at the intersection 161 and subsequently the tearing guide piece 120 is pulled independently of the belt-shaped base 130 in the first exemplary embodiment. As described above, since the belt-shaped base 130 is torn in the longitudinal direction in the course of being pulled together with the tearing guide piece 120, it is necessary to separate the belt-shaped base 130 and the tearing guide piece 120 near the tab 150 to keep the belt-shaped base 130 from being torn. When the surrounding seal area 160 is not provided, it is possible to provide an incision extending in the width direction only in the belt-shaped base 130 at a position corresponding to the intersection 161, at which the belt-shaped base 130 is torn. However, the same function can be achieved by the intersection 161 defined by the surrounding seal area 160 without providing such an incision in the first exemplary embodiment.

Manufacturing Method According to First Exemplary Embodiment

Figure 6:
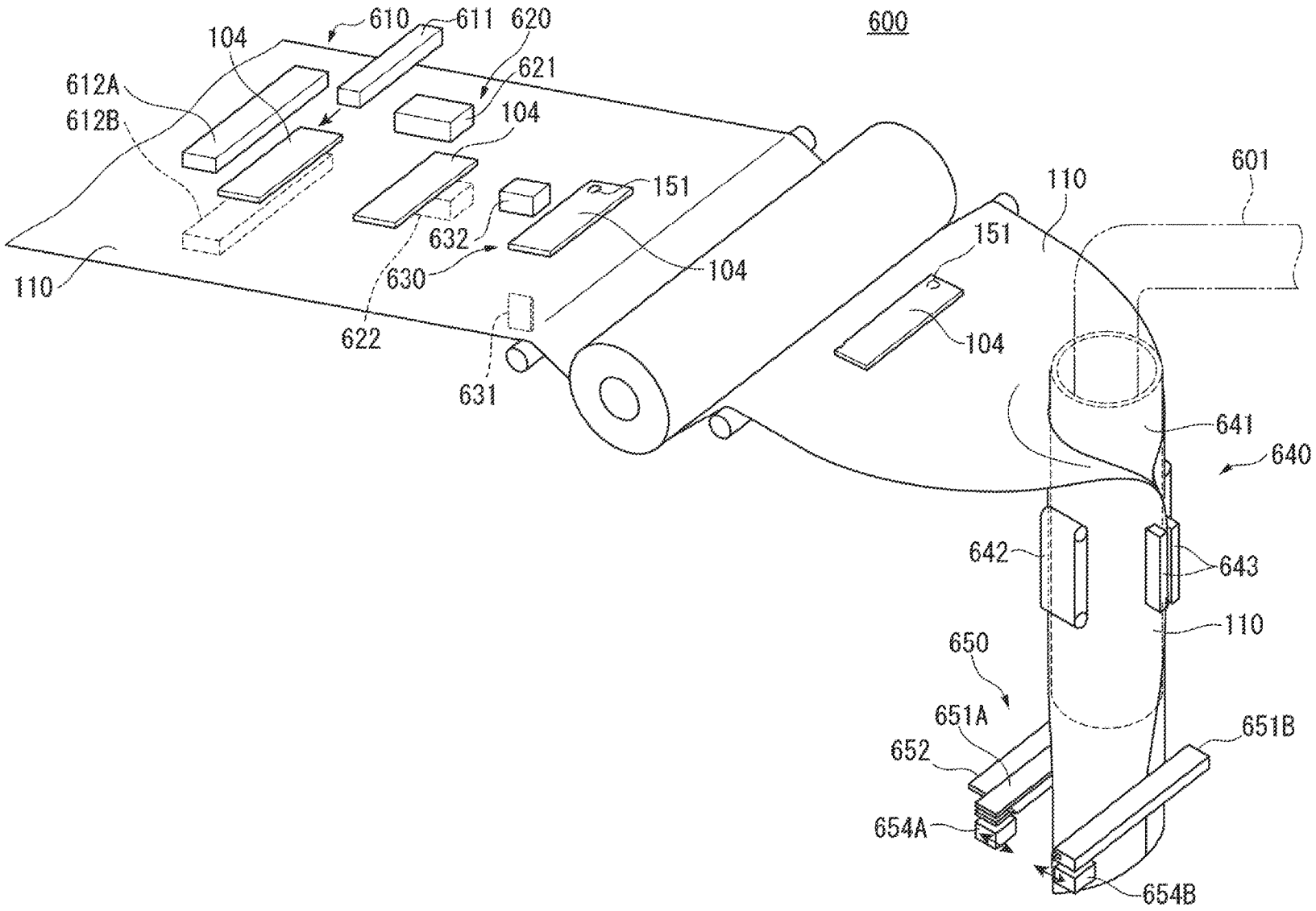
FIG. 6 is an illustration showing a manufacturing process of the bag according to the first exemplary embodiment of the invention.
Figure 7:
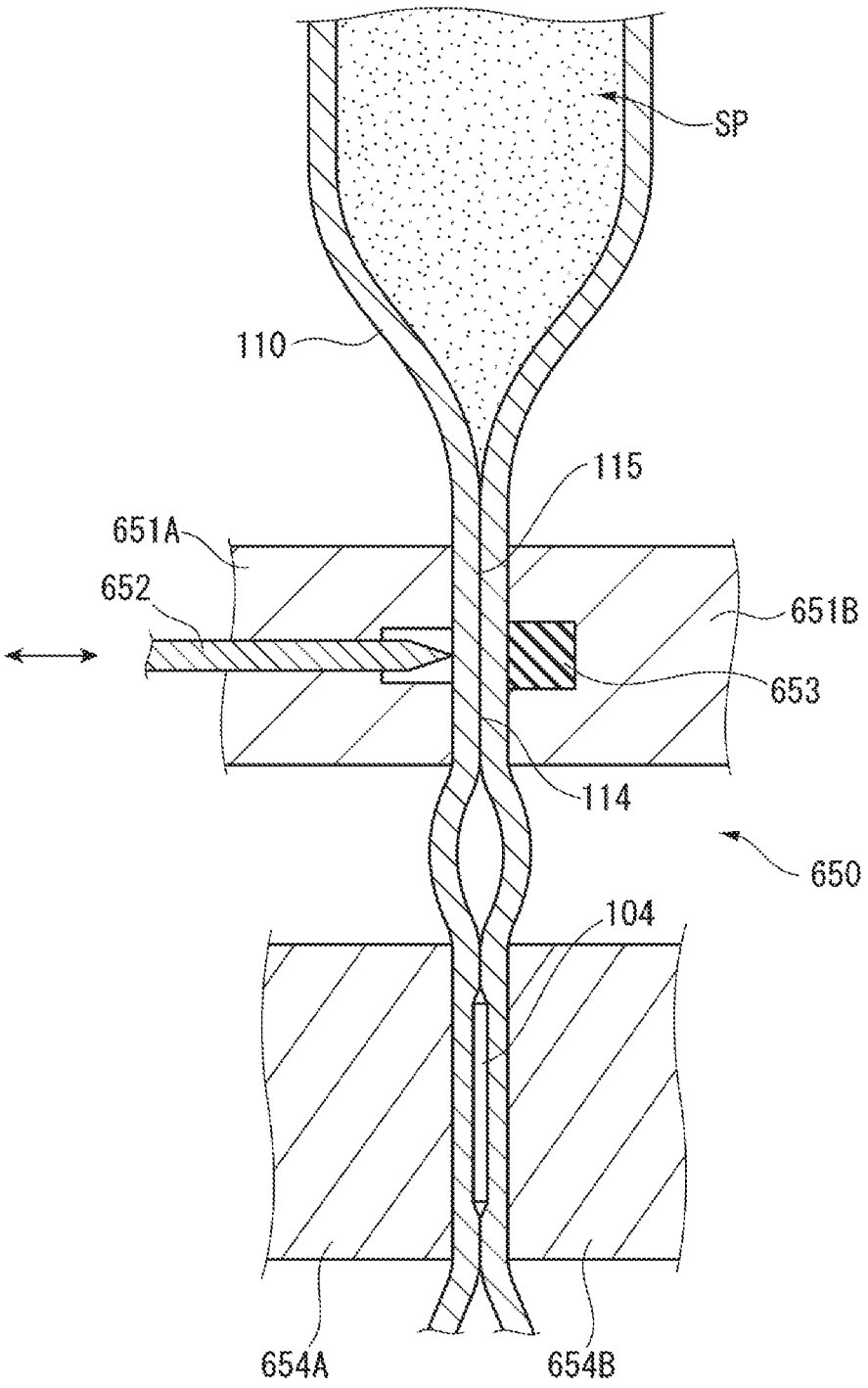
FIG. 7 is an enlarged cross sectional view showing a part of the manufacturing process shown in FIG. 6.

Next, a manufacturing method of a bag according to the first exemplary embodiment of the invention will be described below with reference to FIGS. 6 and 7. FIG. 6 is an illustration showing a manufacturing process of the bag according to the first exemplary embodiment. FIG. 7 is an enlarged cross sectional view showing a part of the manufacturing process shown in FIG. 6.

As shown in FIG. 6, a manufacturing machine 600 includes an elongated-member bonding unit 610, a tab former 620, a cut-portion former 630, a bag former 640, and a top/bottom former 650. It should be noted that the cut-portion former 630 is not requisite when the bag is not provided with the cut portion. The film 110 drawn from a roll or the like (not shown) is intermittently transferred and processed in the above units of the manufacturing machine 600. The above units will be described below.

The elongated-member bonding unit 610 is configured to directly or indirectly bond an elongated member 104 to the longitudinally transferred film 110 along a width direction. In the first exemplary embodiment, the elongated member 104 includes the tearing guide piece 120, the belt-shaped base 130 overlaid on the tearing guide piece 120, and the zipper tape 140 provided continuously from the belt-shaped base 130 in the width direction described with reference to FIG. 1 and the like. As described above with reference to FIG. 1, the belt-shaped base 130 is overlaid on the tearing guide piece 120 from a side opposite the first area 111 of the film 110 in the first exemplary embodiment. This positional relationship is described herein as the belt-shaped base 130 being "overlaid" on the tearing guide piece 120. All of these members, which are elongated members extending in the same direction, can be molded in advance through, for instance, extrusion (including co-extrusion) or the like and collectively bonded on the film 110 in a form of the elongated member 104. In this case, the manufacturing process additionally includes a step for integrally molding the tearing guide piece 120, the belt-shaped base 130, and the zipper tape 140 through, for instance, co-extrusion, which is performed by an extruder (an example of a molding machine) provided, for instance, in the manufacturing machine 600 or separately from the manufacturing machine 600.

Specifically, the elongated-member bonding unit 610 includes a feeder 611, and seal bars 612A, 612B. The feeder 611 is configured to feed the elongated member 104 of a predetermined length and dispose the elongated member 104 at a predetermined position on the film 110. The feeder 611 may include a cutter configured to cut the elongated member 104 into the predetermined length. In the illustrated example, the elongated member 104 is bonded to a part of the film 110 corresponding to the first area 111. Accordingly, the feeder 611 is configured to dispose the elongated member 104 so that the tearing guide piece 120 and the opposite base 141 of the zipper tape 140 are located adjacent to the film 110 and the belt-shaped base 130 is positioned thereon.

Meanwhile, seal bars 612A, 612B are configured to hold the film 110 together with the elongated member 104 and bond the elongated member 104 on the film 110 through heat-seal, ultrasonic seal or the like. Alternatively, an adhesive is applied in advance between the elongated member 104 and the film 110 and the seal bars 612A, 612B may be configured to hold and press the overlapped film 110 and elongated member 104 to bond the elongated member 104 onto the film 110.

The tab former 620 is configured to form the tab 150 in the film 110 and the elongated member 104 bonded to the film 110. Specifically, the tab former 620 includes a cutter 621, and a receiver base 622. The cutter 621 has a profile corresponding to the cut portion 151 defining the tab 150 in a plan view. Since the cut portion 151 has a horse-shoe profile in a plan view in the first exemplary embodiment as described above, the cutter 621 also has a horse-shoe profile in a plan view. In the illustrated example, the elongated member 104 is bonded to a part of the film 110 corresponding to the first area 111. Since the film 110 is not folded at this stage, the cut portion 151 (i.e. the tab 150) penetrating through the first area 111 of the film 110, the tearing guide piece 120 and the belt-shaped base 130 is formed by cutting (penetrating) the elongated member 104 and the film 110 with the cutter 621 in the thickness direction, as described above with reference to FIG. 4.

The cut-portion former 630 is configured to form the cut portion 121 in the film 110 and the elongated member 104 bonded to the film 110. Specifically, the cut-portion former 630 includes a cutter 631, and a receiver base 632. As described above, the cut portion 121 penetrates through the film 110 and the tearing guide piece 120 but does not penetrate through the belt-shaped base 130 in the first exemplary embodiment. Accordingly, the cutting depth of the cutter 631 is adjusted to match a sum of the thicknesses of the film 110 and the tearing guide piece 120. Though not illustrated, after the cut portion 121 is formed, an area around the cut portion 121 may be pressed to improve the sealability of the bag near the cut portion 121.

The bag former 640 is configured to form the seal portion 113 by wrapping both ends of the film 110 in the width direction into a tube, thereby roughly shaping the bag 100 including the first area 111 and the second area 112 of the film 110. Specifically, the bag former 640 includes a roll core 641, a conveyor belt 642, and a sealer 643. The film 110 is, while being wrapped on the roll core 641, transferred from an upper side toward a lower side with the conveyor belt 642. The roll core 641, which has a substantially circular cross section at an upper part, the film 110 can be smoothly wrapped around the roll core 641, which has a substantially circular cross section at an upper part, into a form of a tube. The film 110 wrapped into the form of a tube is folded at both sides thereof in the width direction (i.e. parts corresponding to the side portions 101A, 101B of the bag 100), thereby defining the first area 111 and the second area 112 described above with reference to FIG. 2. The area, to which the elongated member 104 is bonded, defines the first area 111. The sealer 643 is configured to bond the both ends of the wrapped film 110 in the width direction to form the seal portion 113. After the film 110 is folded as described above, the area provided with the seal portion 113 defines the second area 112. The sealer 643, which is an example of a first bonding-portion former, is configured to form the seal portion 113 through heat-seal, ultrasonic seal or the like as in the above-described seal bars 612A, 612B.

The top/bottom former 650 is configured to form seal portions 114, 115 on the film 110 folded at both sides in the width direction and cut the film 110 in the width direction to form the bag 100. Further, the top/bottom former 650 is configured to form the surrounding seal area 160 described with reference to FIG. 1 or the like. FIG. 6 shows an enlarged cross section of the top/bottom former 650. As shown in FIG. 6, the top/bottom former 650 includes seal bars 651A, 651B for the seal portions 114, 115, a cutter 652, a receiver base 653, and sealers 654A, 654B for the surrounding seal area 160.

In the illustrated example, the seal bars 651A, 651B, which are each an example of a second bonding-portion former, are mutually opposed across the cutter 652 in a top-bottom direction to form seal portions 114, 115 extending in the width direction of the film 110. The seal bars 651A, 651B are configured to form the seal portions 114, 115 through heat-seal, ultrasonic seal, or the like as in the above-described seal bars 612A, 612B. The cutter 652 and the receiver base 653 are configured to be moved, along with the seal bars 651A, 651B, toward and away from each other to cut the film 110 in the width direction at a part near the seal portions 114, 115 formed by the seal bars 651A, 651B.

The above-described roll core 641 is a hollow member, into which a filling device 601 is inserted from above. The filling device 601 is configured to discharge the contents in synchronization with the holding operation of the film 110 by the seal bars 651A, 651B of the top/bottom former 650. Thus, the contents are put into the containable space SP formed above the seal portion 115 at the bottom portion 103 of the bag 100. When the seal bars 651A, 651B are separated, the contents are then transferred downward together with the film 110 beyond the seal bars 651A, 651B. Subsequently, the seal portion 114 at the top portion 102 of the bag 100 is formed to seal the containable space SP.

The sealers 654A, 654B, which are each an example of a third bonding-portion former, are configured to hold the film 110 in synchronization with the seal bars 651A, 651B and form the surrounding seal area 160 through heat-seal, ultrasonic seal or the like. As described with reference to FIG. 1 and the like, the surrounding seal area 160, which surrounds the tab 150 and intersects the tearing guide piece 120 in the width direction, is formed between the first area 111 and the second area 112 of the film 110. Sealing heads of the sealers 654A, 654B have profiles corresponding to the surrounding seal area 160 in a plan view. As described above, since the surrounding seal area 160 has a U-shaped profile in a plan view opened at a side close to the side portion 101A of the bag in the first exemplary embodiment, the seal heads of the sealers 654A, 654B each also have U-shaped profile in a plan view. Alternatively, the seal heads of the sealers 654A, 654B each may be configured to have different profiles in plan view depending on parts thereof, where a part of the seal head facing the film 110 has a U-shaped profile and a part remote from the film 110 is not in a form of the U-shape (e.g. rectangular profile with one side located remote from the film 110).

The bag 100 according to the first exemplary embodiment is producible according to the process described above. It should be noted that the above process is merely exemplary and various modifications are possible. For instance, the order of the tab former 620 and the cut-portion former 630 in the above example may be reversed. Alternatively, the tab former 620 and the cut-portion former 630 may be integrated and the tab 150 and the cut portion 121 may be substantially simultaneously formed. In some embodiments, the seal bars 651A, 651B in the top/bottom former 650 are separated from the cutter 652 and the receiver base 653, and the film 110 may be cut in the width direction after the seal portions 114, 115 are formed.

In still other embodiments, the sealers 654A, 654B form the surrounding seal area 160 before the seal portions 114, 115 are formed by the seal bars 651A, 651B. For instance, the sealers 654A, 654B may be provided above the seal bars 651A, 651B and configured to form the surrounding seal area 160 before the seal portion 115 located at the bottom portion 103 of the bag 100 is formed, so that the contents to be put into the bag in synchronization with the formation of the seal portion 115 can be kept from being adhered on an inner side of the surrounding seal area 160.

It should be noted that bags according to modifications of the first exemplary embodiment are producible through a combination of the above-described manufacturing process of the bag 100 according to the first exemplary embodiment and other known manufacturing process of the bag, or substitution of a part of the manufacturing process of the bag 100 with other manufacturing process of the bag. Accordingly, the explanation of the manufacturing process will be omitted in the description of the modifications of the first exemplary embodiment below.

Summary of First Exemplary Embodiment

In the first exemplary embodiment of the invention, the tape base 132 of the zipper tape 140 is a part of the belt-shaped base 130 bonded to the first area 111 of the film 110 and the opposite base 141 is also bonded to the first area 111 as shown in, for instance, FIG. 3. The above configuration allows the contents to be put into the containable space SP of the bag 100 without disengaging the engagement portion 142 of the zipper tape 140 as shown in FIG. 6.

However, when the tab 150 for allowing the user to pinch the tearing guide piece 120 and form an opening in the film 110 is formed, the belt-shaped base 130 is cut at the cut portion 151 in a shape of the tab 150 (horse-shoe shape in the above example) together with the first area 111 of the film 110 and the tearing guide piece 120. In this case, the containable space SP between the belt-shaped base 130 and the second area 112 of the film 110 is in communication with an outer space of the bag 100 through the cut portion 151 without taking any measures, failing to keep the sealability of the containable space SP.

Accordingly, the surrounding seal area 160 is formed in the first exemplary embodiment. The surrounding seal area 160, which is formed between the first area 111 and the second area 112 of the film 110, surrounds the tab 150 in cooperation with the side portion 101A of the bag 100. Thus, the space defined in an area surrounding the tab 150 and located between the first area 111 and the second area 112 of the film 110 is spatially separated from the containable space SP partitioned by the surrounding seal area 160, so that the sealability of the containable space SP can be kept even when the tab 150 is provided.

Further, the surrounding seal area 160 in the first exemplary embodiment is formed in an area intersecting the tearing guide piece 120 in the width direction, so that the belt-shaped base 130 can be torn at the intersection 161 between the tearing guide piece 120 and the surrounding seal area 160 when a user pinches the tearing guide piece 120 to form an opening in the film 110. If the belt-shaped base 130 is torn in conjunction with the tearing guide piece 120, the sealability of the containable space SP after being resealed by the zipper tape 140 cannot be ensured. Accordingly, without the surrounding seal area 160, an additional step of, for instance, providing an incision in the width direction only in the belt-shaped base 130 at a part near the tab 150 becomes necessary. However, the surrounding seal area 160 formed in the first exemplary embodiment eliminates the necessity of such an additional step.

Modification of First Exemplary Embodiment

Figure 8:
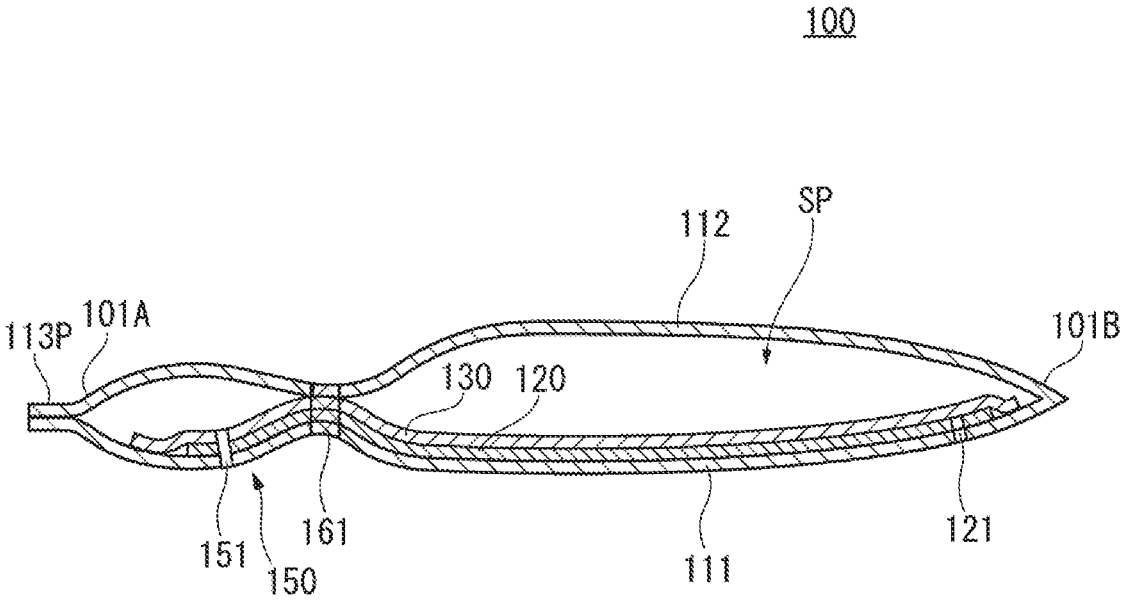
FIG. 8 is an illustration showing a first modification of the first exemplary embodiment of the invention.
Figure 9:
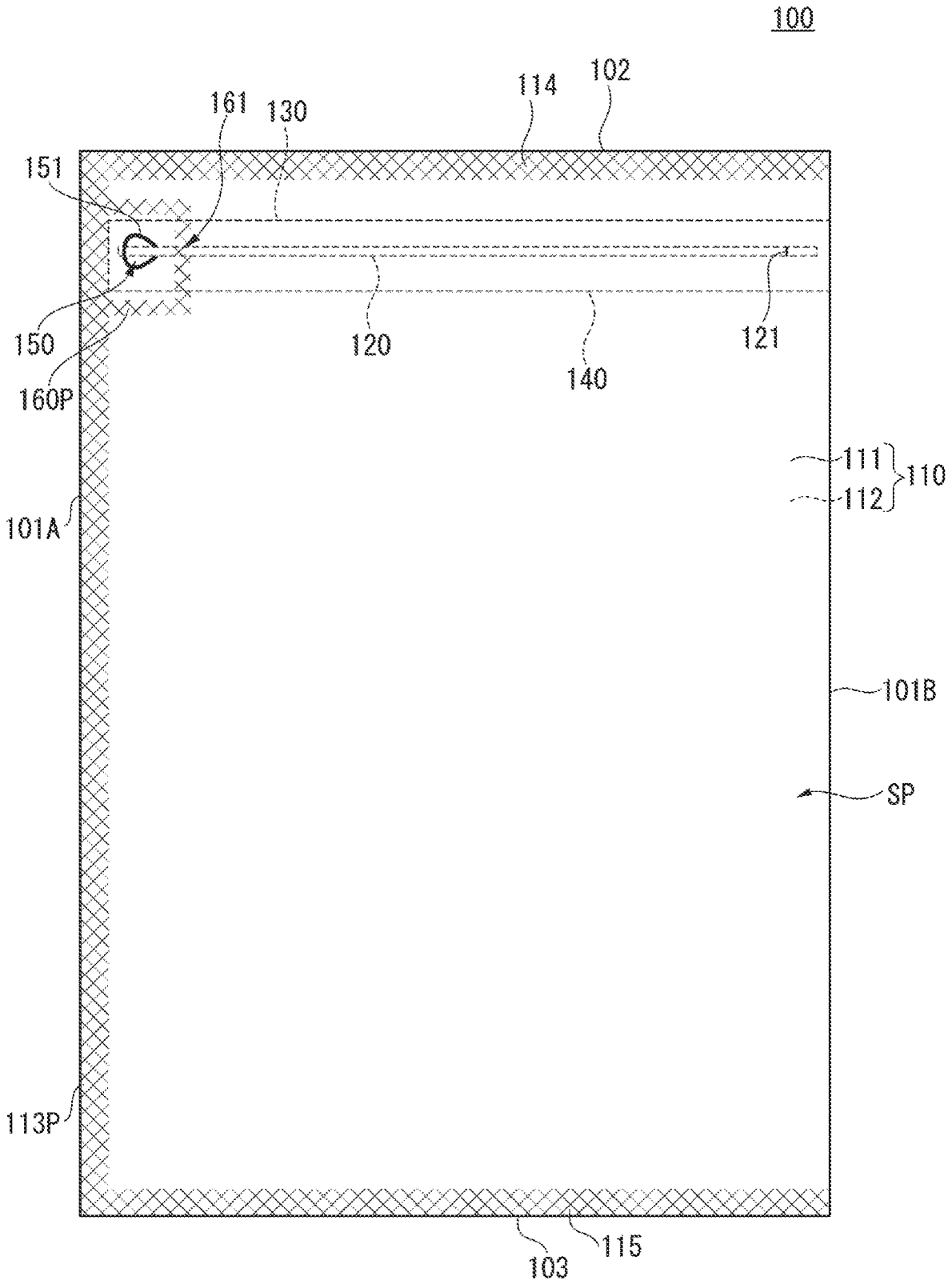
FIG. 9 is another illustration showing the first modification of the first exemplary embodiment of the invention.

FIGS. 8 and 9 are illustrations showing a first modification of the first exemplary embodiment of the invention. As shown in FIG. 8, unlike the example explained above with reference to FIG. 2, in the first modification, both ends of the film 110 folded to define the first area 111 (at a front side) and the second area 112 (at the rear side) of the bag 100 are mutually bonded at a seal portion 113P defined at the side portion 101A of the bag 100. The seal portion 113P may be provided by a fin-seal or envelop seal as in the above-described seal portion 113. As shown in FIG. 9, a surrounding seal area 160P in the first modification, which has a U-shaped profile (in a plan view) continuous with the seal portion 113P, surrounds the tab 150 in cooperation with the seal portion 113P.

Figure 10:
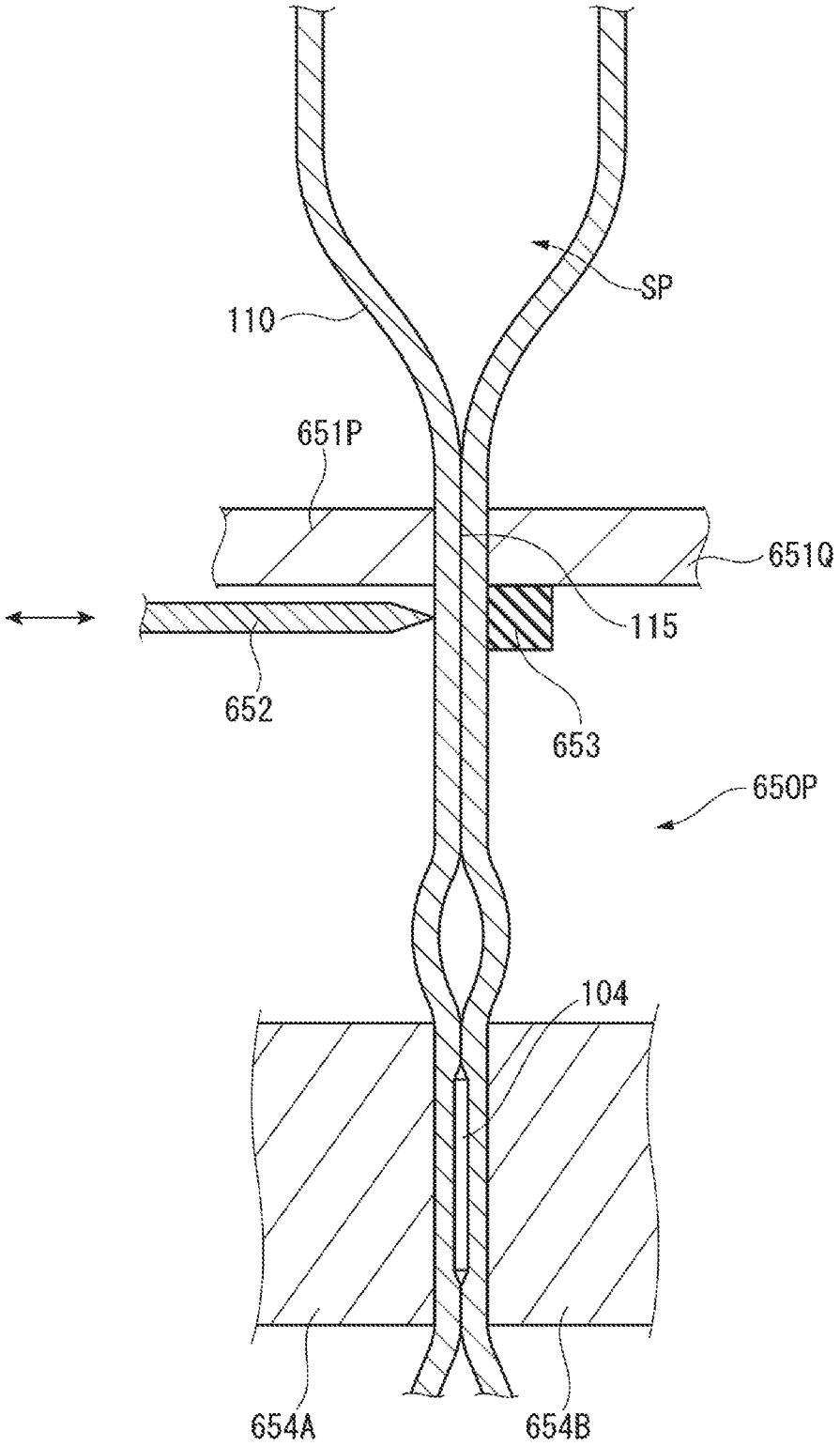
FIG. 10 is an illustration showing a second modification of the first exemplary embodiment of the invention.
Figure 11:
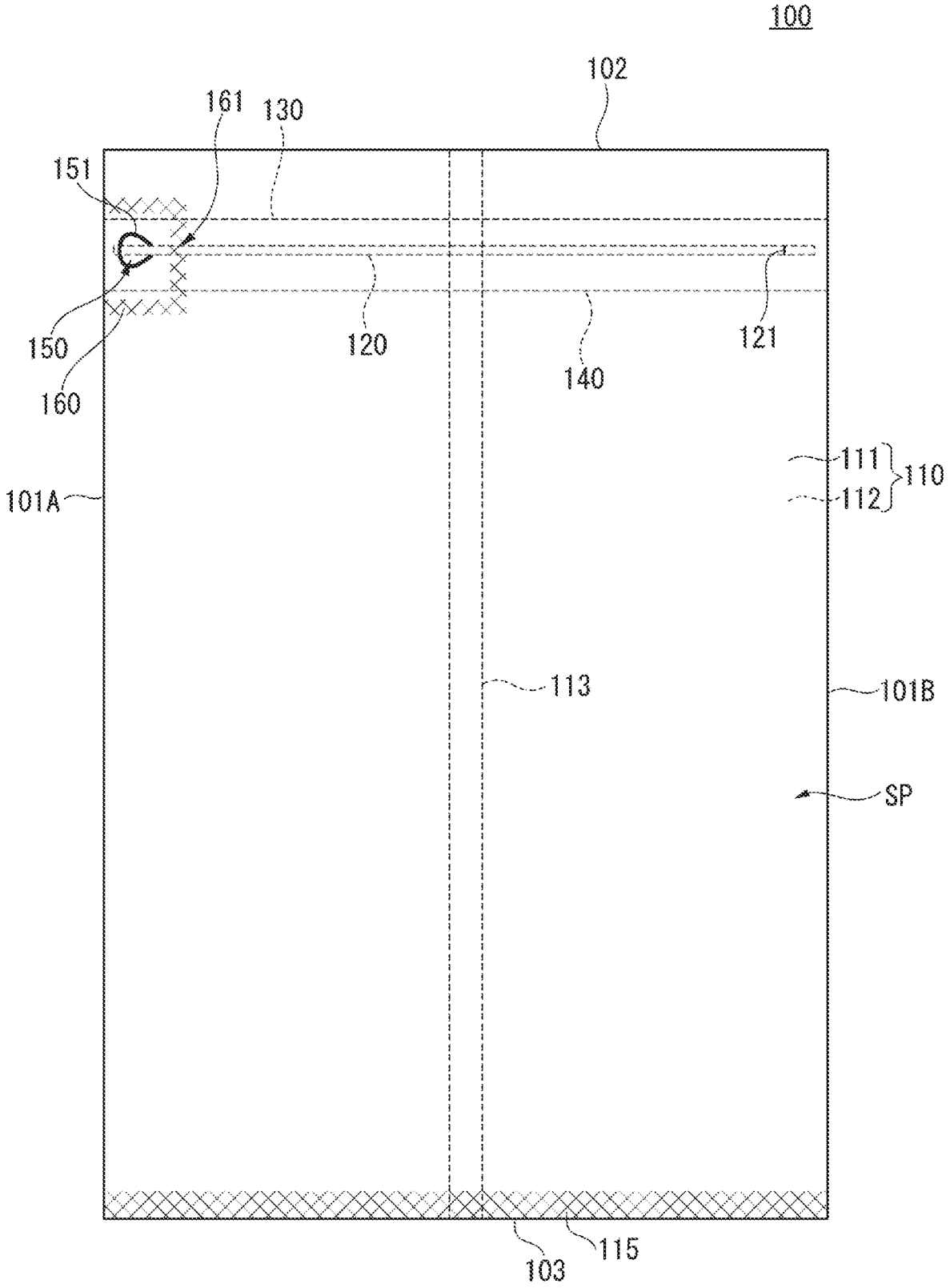
FIG. 11 is another illustration showing the second modification of the first exemplary embodiment of the invention.
Figure 12:
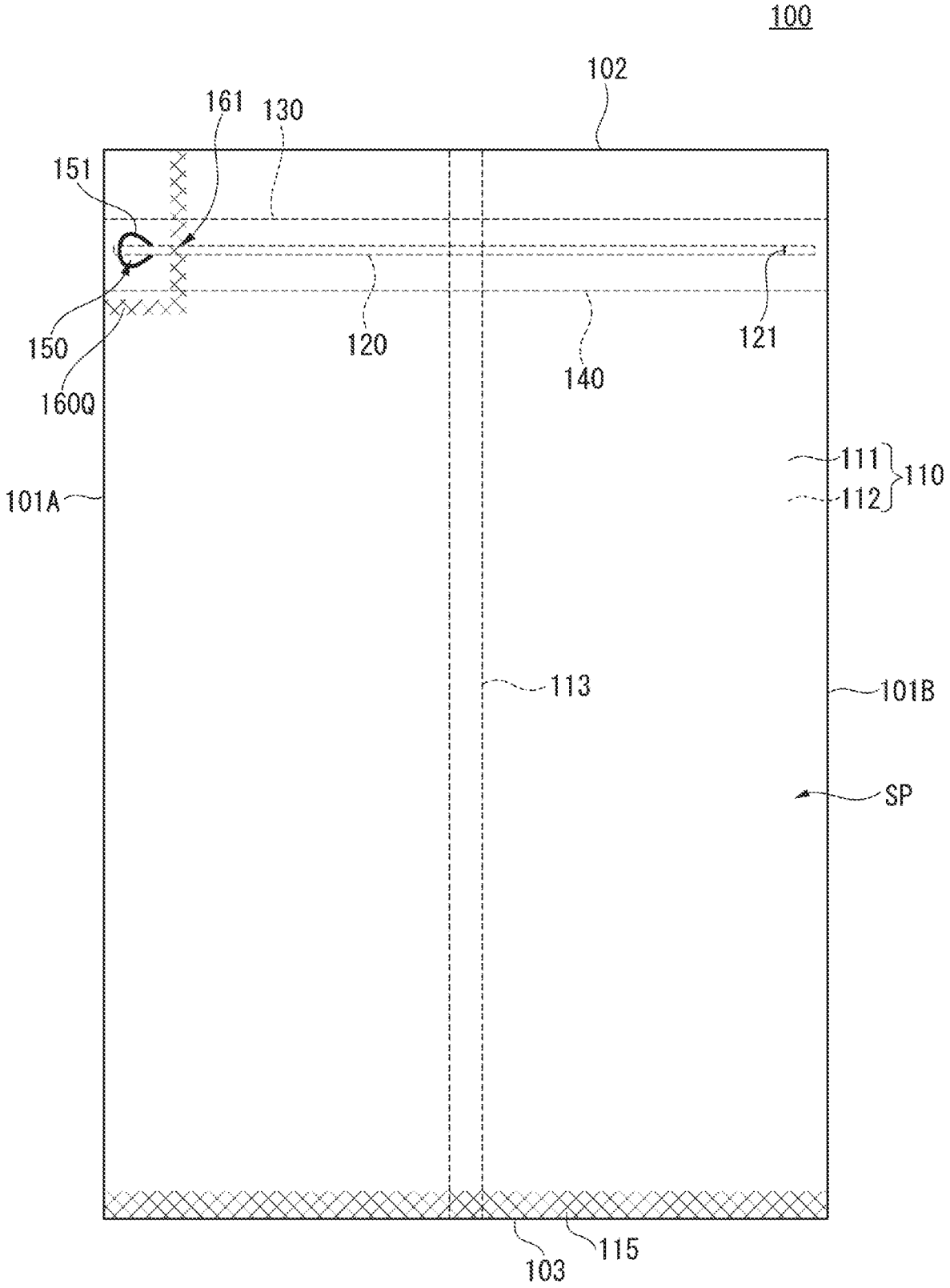
FIG. 12 is still another illustration showing the second modification of the first exemplary embodiment of the invention.

FIGS. 10 to 12 are illustrations showing a second modification of the first exemplary embodiment of the invention. As shown in FIG. 10, the contents has not been put into the containable space SP when the bag 100 is manufactured in the second modification, unlike the example explained above with reference to FIGS. 6 and 7. In this arrangement, a top/bottom former 650P of the manufacturing machine 600 includes seal bars 651P, 651Q for forming the seal portion 114 at the bottom portion 103 of the bag 100, the cutter 652, the receiver base 653, and the sealers 654A, 654B for forming the surrounding seal area 160. Thus, the bag 100 with the top portion 102 being opened as shown in FIG. 11 is produced. The seal portion 114 for the top portion 102 not formed by the manufacturing machine 600 is separately provided after the contents are put into the bag 100 by an intermediate user. FIG. 12 is an illustration showing another example of the second modification different from the example shown in FIG. 11. In this example, a surrounding seal area 160Q has an L-shaped profile in a plan view with an open side near the top portion 102 in addition to the side portion 101A of the bag 100. When the seal portion 114 is later provided to the top portion 102, a part of the surrounding seal area 160Q near the top portion 102 becomes continuous with the seal portion 114, so that the tab 150 is surrounded by the surrounding seal area 160Q.

Figure 13:
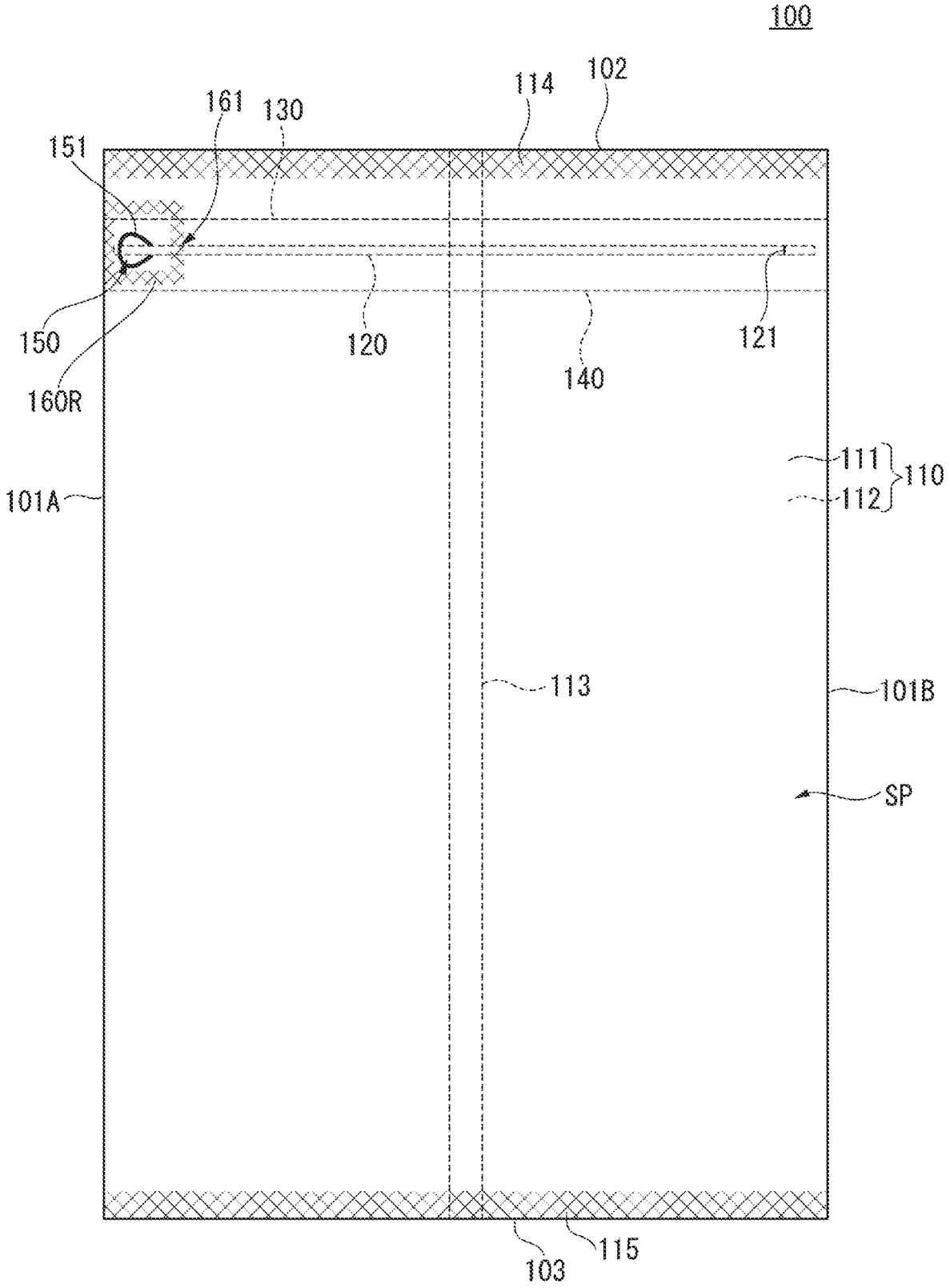
FIG. 13 is an illustration showing a third modification of the first exemplary embodiment of the invention.

FIG. 13 is an illustration showing a third modification of the first exemplary embodiment of the invention. As shown in FIG. 13, a surrounding seal area 160R in the third modification has a rectangular profile in a plan view surrounding the tab 150, unlike the example explained above with reference to FIG. 1. In the exemplary embodiments of the invention, the surrounding seal area may surround the tab 150 by itself as in the above, or may surround the tab 150 in cooperation with the side portion 101A of the bag 100 as in the example shown in FIG. 1 or in cooperation with other seal portion as in the example shown in FIG. 9. Further, though the surrounding seal area 160 in the example shown in FIG. 1 is provided in the area intersecting in the width direction the entirety of the belt-shaped base 130 and the zipper tape 140 in addition to the tearing guide piece 120, the surrounding seal area 160R may be provided in an area solely intersecting the tearing guide piece 120 in the width direction as in the example shown in FIG. 13.

Second Exemplary Embodiment

Figure 14:
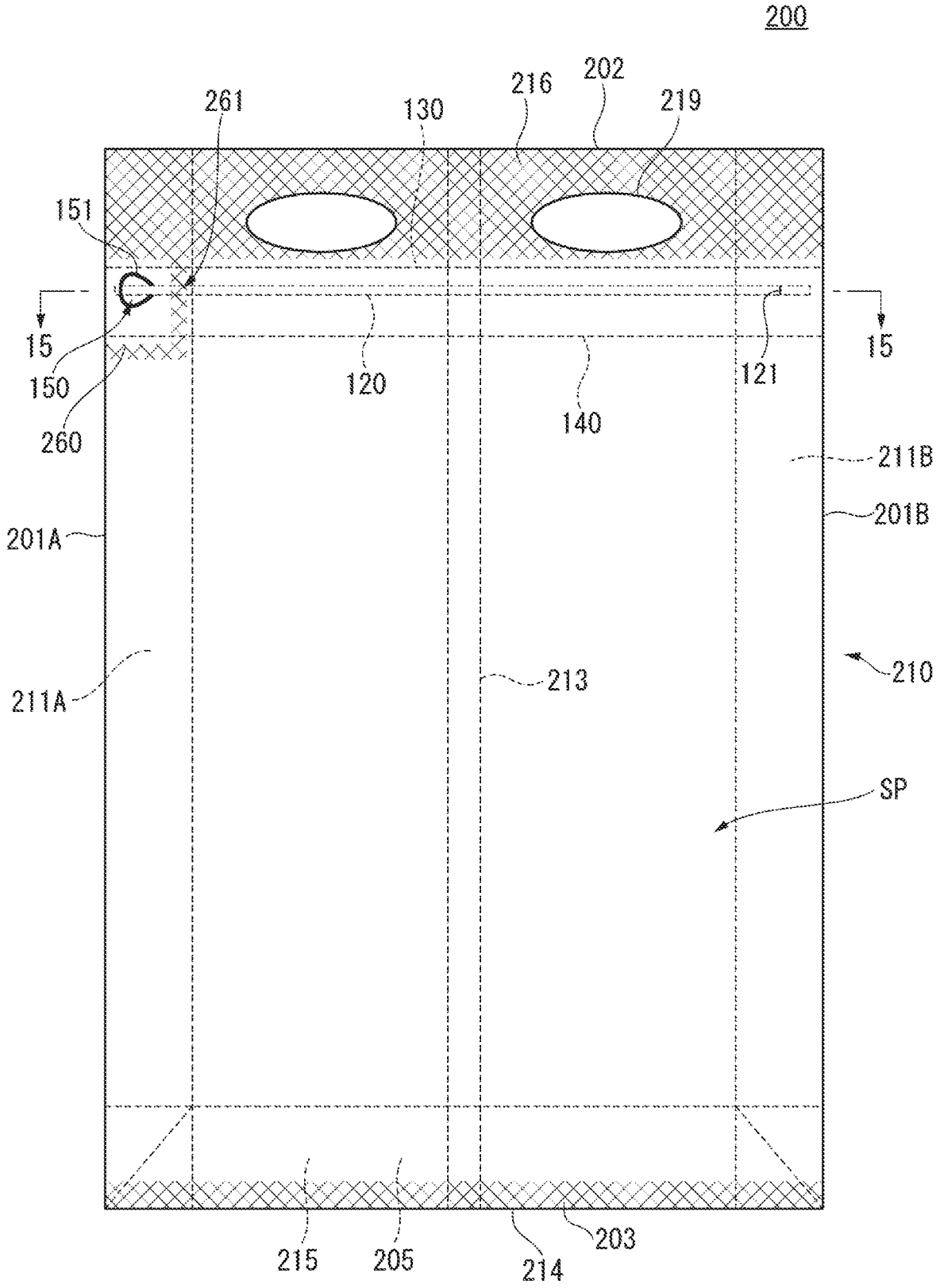
FIG. 14 is a front elevational view showing a bag according to a second exemplary embodiment of the invention.
Figure 15:
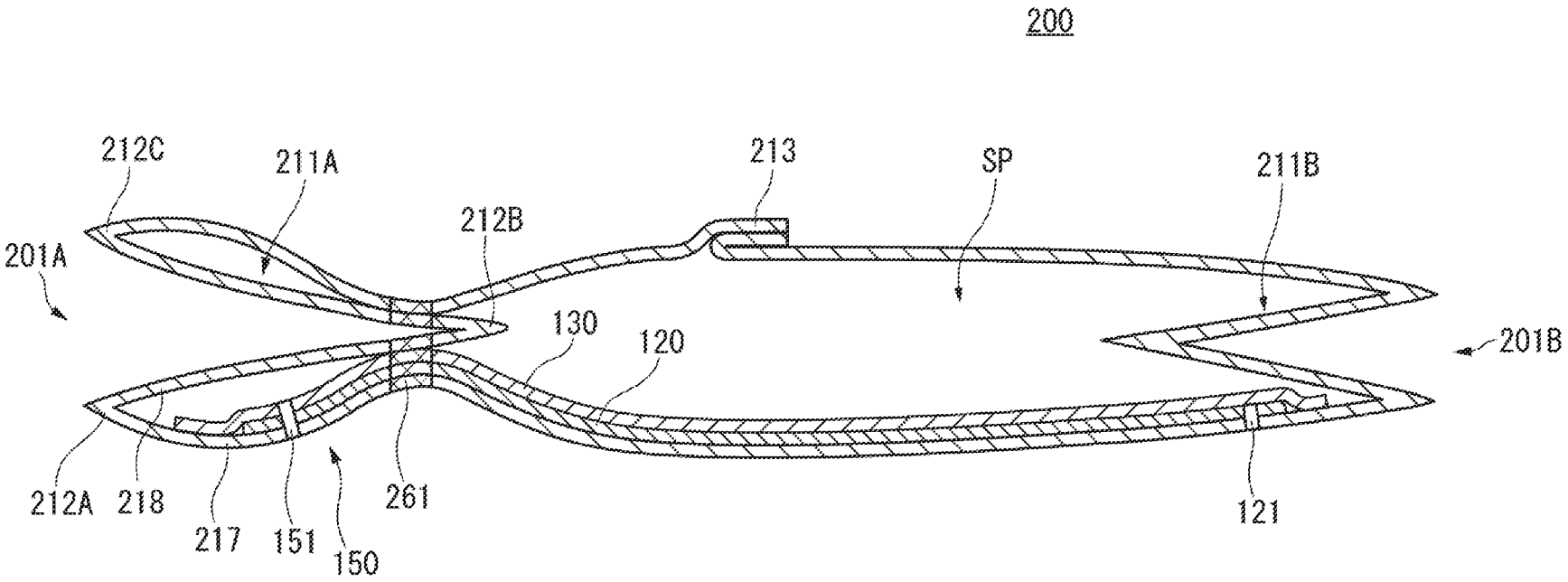
FIG. 15 is a cross sectional view of the bag shown in FIG. 14 taken along 15-15 line.

Next, a second exemplary embodiment of the invention will be described below with reference to FIGS. 14 and 15. FIG. 14 is a front elevational view showing a bag according to the second exemplary embodiment. FIG. 15 is a cross sectional view of the bag shown in FIG. 14 taken along 15-15 line.

As shown in FIG. 14, a bag 200 includes a film 210, the tearing guide piece 120, the belt-shaped base 130, the zipper tape 140, the tab 150, and a surrounding seal area 260. It should be noted that the components of the bag 200 other than the below-described components related to the film 210 are the same as the components of the bag 100 according to the above-described first exemplary embodiment and duplicated explanation therefor will be omitted herein.

The bag 200 is a so-called gusset bag. As shown in FIG. 15, the film 210 includes portions 211A, 211B interfolded toward the containable space SP and provided at the side portions 201A, 201B of the bag 200, respectively. In the second exemplary embodiment, the above portions 211A, 211B are formed by folding the film 210 thrice at the side portions 201A, 201B of the bag 200. FIG. 15 shows folded portions 212A, 212B, 212C (ordered from the front side of the bag 200) at the side portion 201A. Both ends of the film 210 folded at the side portions 201A, 201B of the bag 200 are mutually bonded at a seal portion 213 at the rear side of the bag 200. The seal portion 213 may be provided by a fin-seal or envelop seal as in the above-described seal portion of the first exemplary embodiment. A film 205 independent of the film 210 is bonded at the seal portion 214 at a bottom portion 203 of the bag 200, the film 205 being interfolded toward the containable space SP to define a portion 215.

As shown in FIG. 14, the surrounding seal area 260 is located at the same area as in the first exemplary embodiment viewed from the front side (i.e. an area surrounding the tab 150 and intersecting the tearing guide piece 120 in the width direction). However, as described above, the film 210 in the second exemplary embodiment is interfolded at the side portion 201A of the bag 200 toward the containable space SP to define the portion 211A. Accordingly, a first area 217, which is a part of the front side of the bag 200 bonded with the tearing guide piece 120 and the belt-shaped base 130, and a second area 218, which is a part of the interfolded portion 211A and continuous with the first area 217 through the folded portion 212A, are bonded at the surrounding seal area 260. In other words, the second area 218, which is bonded with the first area 217 at the surrounding seal area 260, is an area defining the portion 211A interfolded at the side portion 201A of the bag 200 in the second exemplary embodiment. In the illustrated example, the surrounding seal area 260, which is adjacent to the folded portion 212A at the side portion 201A of the bag 200 and the seal portion 216 at the top portion 202 of the bag 200, surrounds the tab 150 in cooperation with the side portion 201A and the seal portion 216.

As shown in FIG. 14, side portions 201A, 201B of the bag 200 formed by folding the film 210 are also spaced apart from the longitudinal ends of the tearing guide piece 120, the belt-shaped base 130, and the zipper tape 140 in the second exemplary embodiment. More specifically, the longitudinal end of the above components are spaced apart from the side portion 201A (and the side portion 201B) of the bag 200 defined by folding the film 210 at the folded portion 212A as shown in FIG. 15. This is because the film 210 is folded at the folded portion 212A (and the folded portions 212B, 212C) after the tearing guide piece 120, the belt-shaped base 130, and the zipper tape 140 are cut into a predetermined length and then bonded to the film 210 during the manufacturing process of the bag 200 to define the side portion 201A.

The above-described surrounding seal area 260 offers the same effect as that of the above-described surrounding seal area 160 formed in the bag 100 according to the first exemplary embodiment. Specifically, the surrounding seal area 260 spatially isolates the space defined in an area surrounding the tab 150 and located between the first area 217 and the second area 218 of the film 210 from the containable space SP, so that the sealability of the containable space SP can be kept even when the tab 150 is provided. Further, the belt-shaped base 130 can be torn at an intersection 261 between the tearing guide piece 120 and the surrounding seal area 260 when a user pinches the tearing guide piece 120 to form an opening in the film 210.

Further, as shown in FIG. 14, through holes 219 are provided in the seal portion 216 of the film 210 at the top portion 202 of the bag 200. The through holes 219, which are ellipsoidal in the illustrated example, allow a user to insert fingers or the like therein to hold the bag 200. It should be noted that a holder of the bag 200 is not limited to the through holes 219 of the illustrated configuration, but may alternatively be a through hole(s) in a form other than an ellipsoid provided near the top portion 202 of the bag 200, or a handle made of fiber, resin, metal or the like attached to the top portion 202.

It should be noted that these components of the bag 200 in the second exemplary embodiment (i.e. the portions 211A, 211B of the film 210 interfolded toward the containable space SP at the side portions 201A, 201B, the portion 215 of the additional film 205 at the bottom portion 203 interfolded toward the containable space SP, and the holder of the bag 200 such as the through holes 219) are capable of being separately provided to the bags according to the exemplary embodiments of the invention. For instance, the interfolded portion 215 at the bottom portion 203 of the second exemplary embodiment may be provided to the bottom portion 103 of the bag 100 according to the above-described first exemplary embodiment. Further, the holder (e.g. the through holes and handle) for holding the bag 100 may be provided to the top portion 102 of the bag 100 according to the first exemplary embodiment.

As described above, the tab 150 and the surrounding seal area 260 provided in the second exemplary embodiment offer the same effects as those in the above first exemplary embodiment. In addition, the interfolded portion of the film in the second exemplary embodiment increases the volume of the containable space SP. Further, with the holder (e.g. the through holes 219) for holding the bag 200, the bag 200 can be easily handled (e.g. transported).

Figure 16:
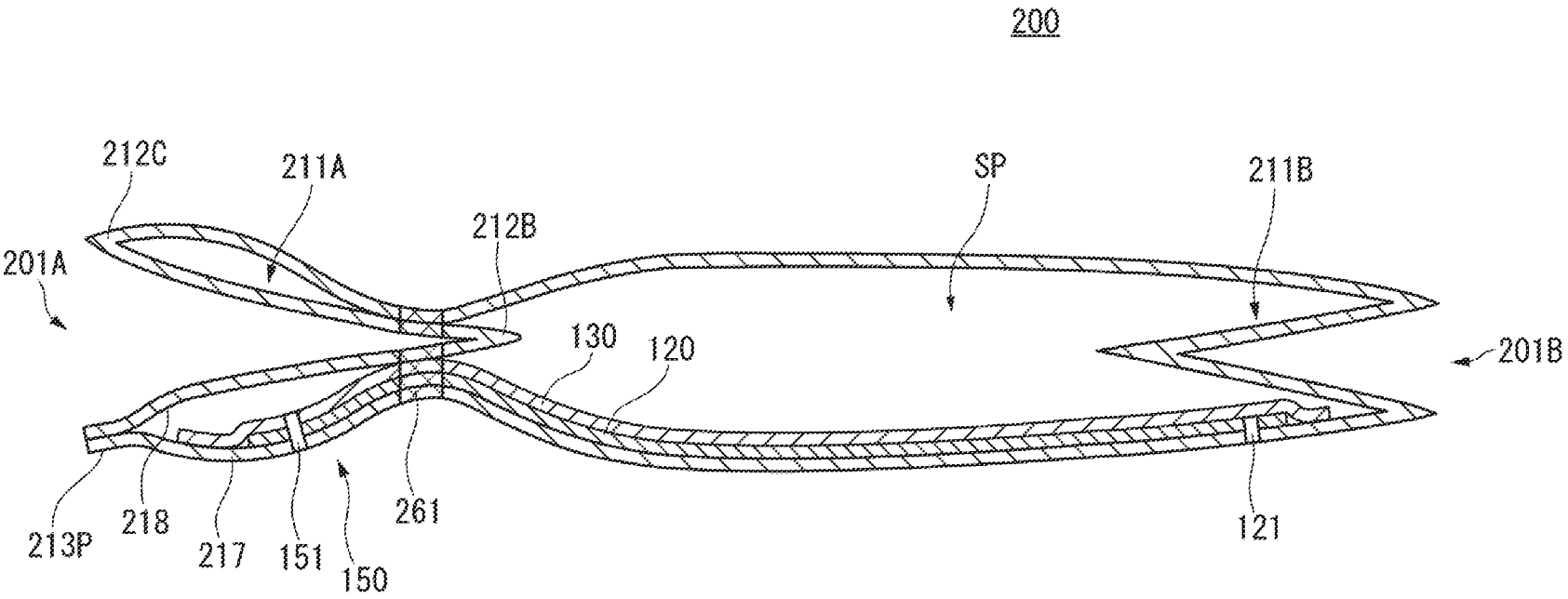
FIG. 16 is an illustration showing a modification of the second exemplary embodiment of the invention.

FIG. 16 is an illustration showing a modification of the second exemplary embodiment of the invention. As shown in FIG. 16, unlike the example explained above with reference to FIG. 15, both ends of the film 210 are mutually bonded at a seal portion 213P defined at the side portion 201A of the bag 200 in this modification. The seal portion 213P may also be provided by a fin-seal or envelop seal as in the above-described seal portion 213. In this modification, the surrounding seal area 260, which has a U-shaped profile in a plan view and is continuous with the seal portion 213P as in the surrounding seal area 160P of the modification of the above first exemplary embodiment, surrounds the tab 150 in cooperation with the seal portion 213P. It should be noted that the second and third modifications of the first exemplary embodiment are also applicable in the same manner in the second exemplary embodiment.

Third Exemplary Embodiment

Figure 17:
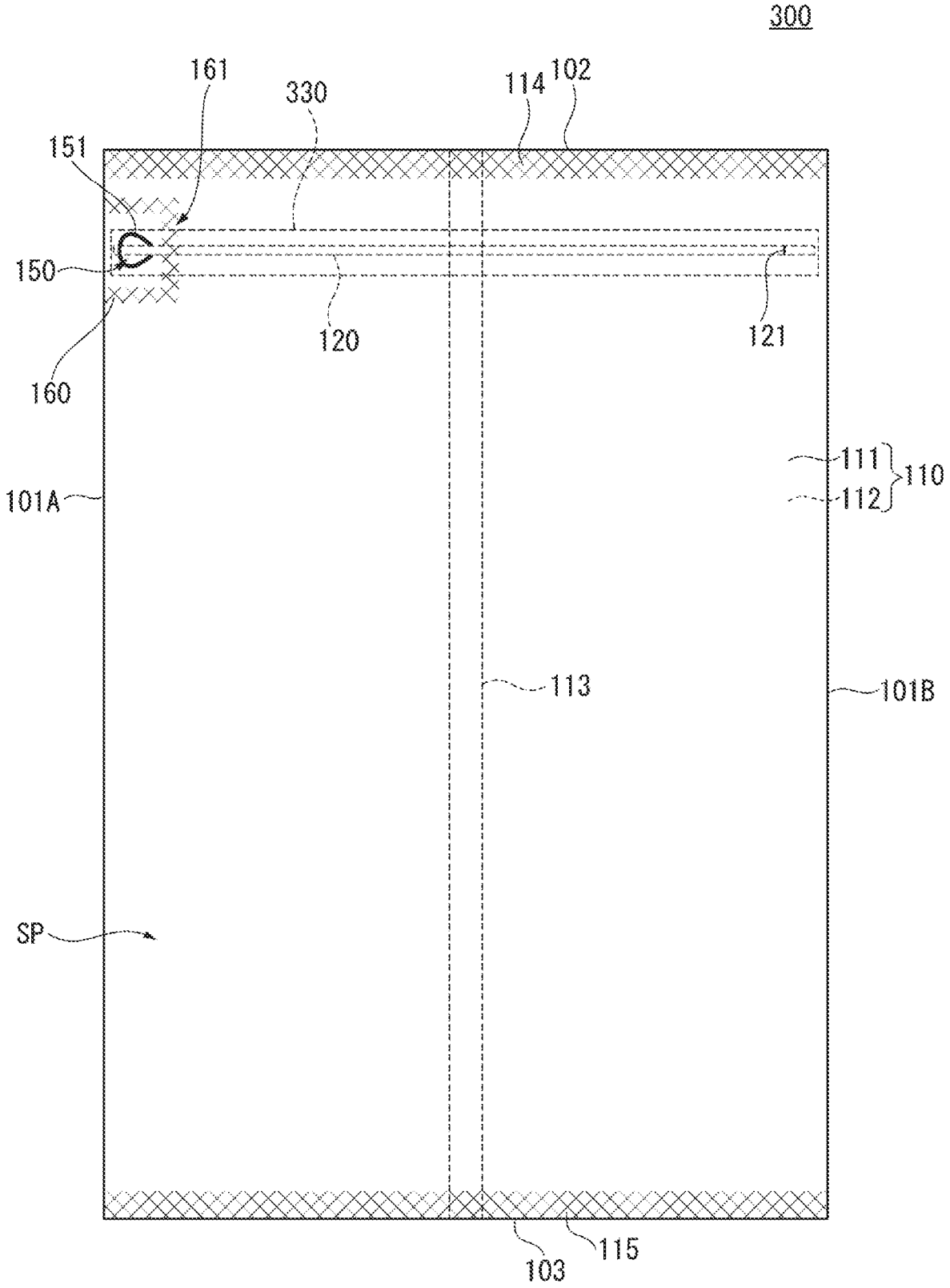
FIG. 17 is a front elevational view showing a bag according to a third exemplary embodiment of the invention.
Figure 18:
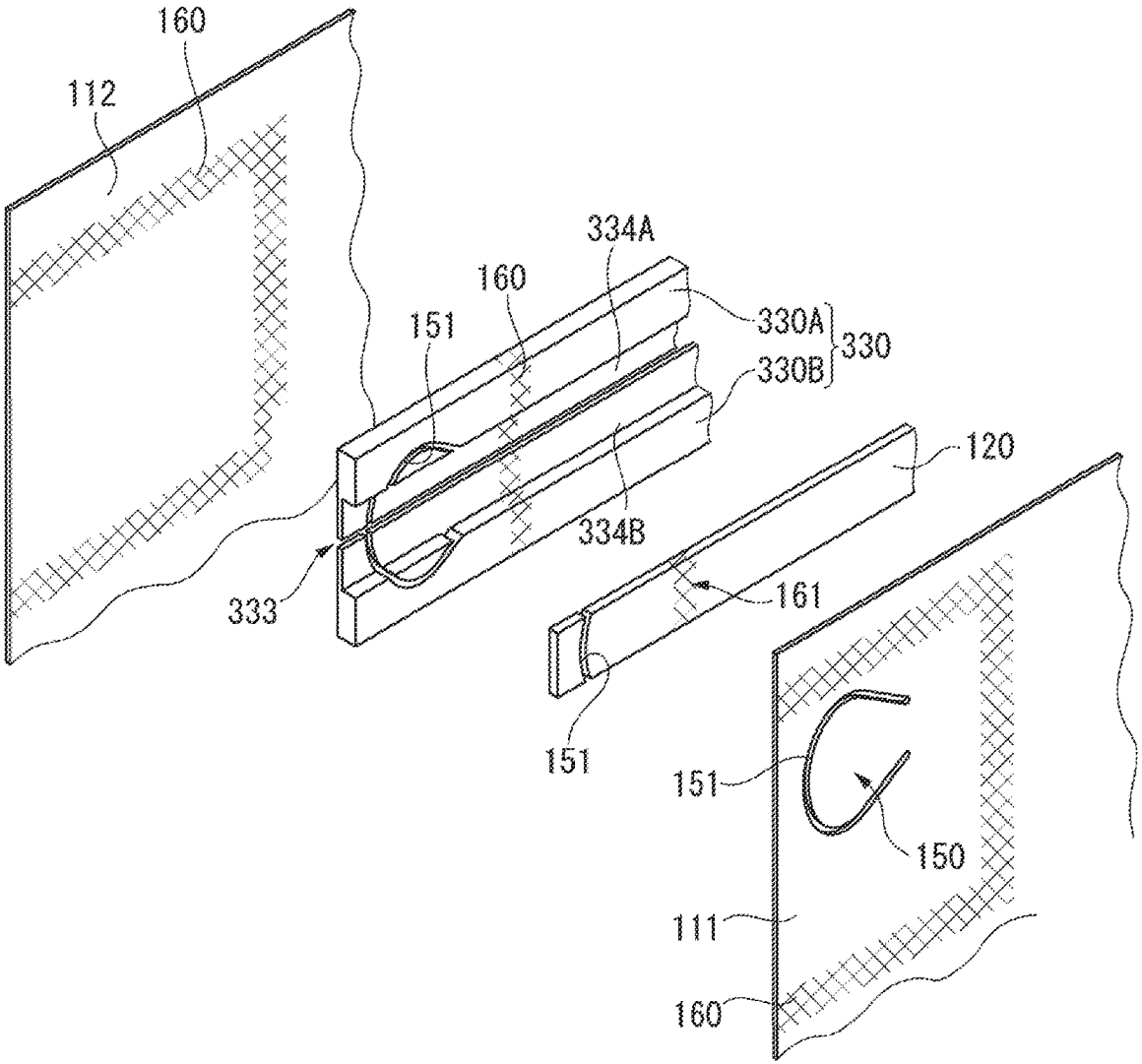
FIG. 18 is an exploded perspective view of a portion including a tab formed in the bag shown in FIG. 17.

Next, a third exemplary embodiment of the invention will be described below with reference to FIGS. 17 and 18. FIG. 17 is a front elevational view showing a bag according to the third exemplary embodiment. FIG. 18 is an exploded perspective view of a portion including the tab formed in the bag shown in FIG. 17.

As shown in FIG. 17, a bag 300 includes the film 110, the tearing guide piece 120, a belt-shaped base 330, the tab 150, and the surrounding seal area 160. It should be noted that the components of the bag 300 other than the below-described components related to the belt-shaped base 330 are the same as the components of the bag 100 according to the above-described first exemplary embodiment and duplicated explanation therefor will be omitted herein.

The belt-shaped base 330 is an elongated member disposed along the tearing guide piece 120 between the tearing guide piece 120 and the second area 112 of the film 110. Unlike the belt-shaped base 130 described above in the first exemplary embodiment, the belt-shaped base 330 is bonded to the first area 111 of the film 110 of the bag 300, which does not include the zipper tape, at both ends in the width direction in the third exemplary embodiment. Further, in the illustrated example, the belt-shaped base 330 is divided into two portions 330A, 330B in the width direction, and a gap 333 is provided between the portions 330A, 330B. Step portions 334A, 334B stepped downward toward the gap 333 are provided to the portions 330A, 330B, respectively. The tearing guide piece 120 is disposed at a lower step formed by the step portions 334A, 334B. After an opening is formed in the bag 100 by the tearing guide piece 120, the gap 333 is in communication with the opening so that a user is capable of accessing the containable space SP in the bag 300 through the opening and the gap 333.

As in the above first exemplary embodiment, the tearing guide piece 120 and the belt-shaped base 330 are each made of respective ones of a pair of incompatible resins in the third exemplary embodiment. Thus, interfacial peeling occurs between the belt-shaped base 330 and the tearing guide piece 120 when an opening is formed by the tearing guide piece 120. Since the shape of the belt-shaped base 330 is maintained through the interfacial peeling, the shape of the bag 300 is kept stable, for instance, after an opening is formed in the bag 300.

The tab 150 and the surrounding seal area 160 provided in the third exemplary embodiment offer the same effects as those in the above-described first exemplary embodiment. Specifically, the formation of the tab 150 provides a start point for a user to pull the tearing guide piece 120 and facilitates creation of the opening in the bag 300. Further, the surrounding seal area 160 spatially isolates the space defined in an area surrounding the tab 150 and located between the first area 111 and the second area 112 of the film 110 from the containable space SP, so that the sealability of the containable space SP can be kept even when the tab 150 is provided.

It should be noted that the third exemplary embodiment is combinable with the second exemplary embodiment. Specifically, an interfolded portion of the film may be provided to one or more of the side portions 101A, 101B and the bottom portion 103 of the bag 300 of the third exemplary embodiment without the zipper tape. Further, a holder (e.g. a through hole(s) and a handle) for the bag 300 may be provided in the third exemplary embodiment. In addition, the first to third modifications of the first exemplary embodiment and the modification of the second exemplary embodiment are also applicable in the same manner in the third exemplary embodiment.

Fourth Exemplary Embodiment

Figure 19:
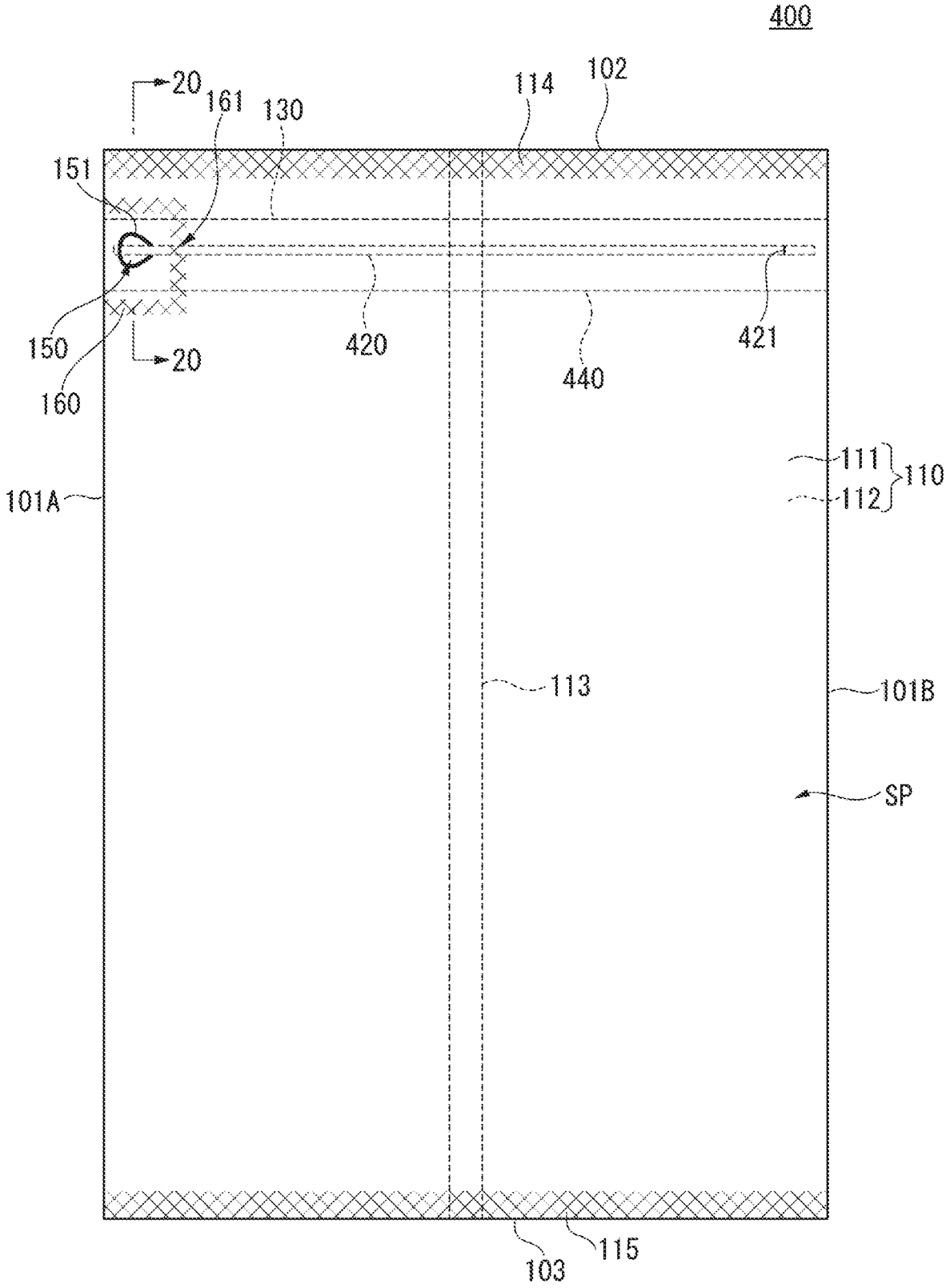
FIG. 19 is a front elevational view showing a bag according to a fourth exemplary embodiment of the invention.
Figure 20:
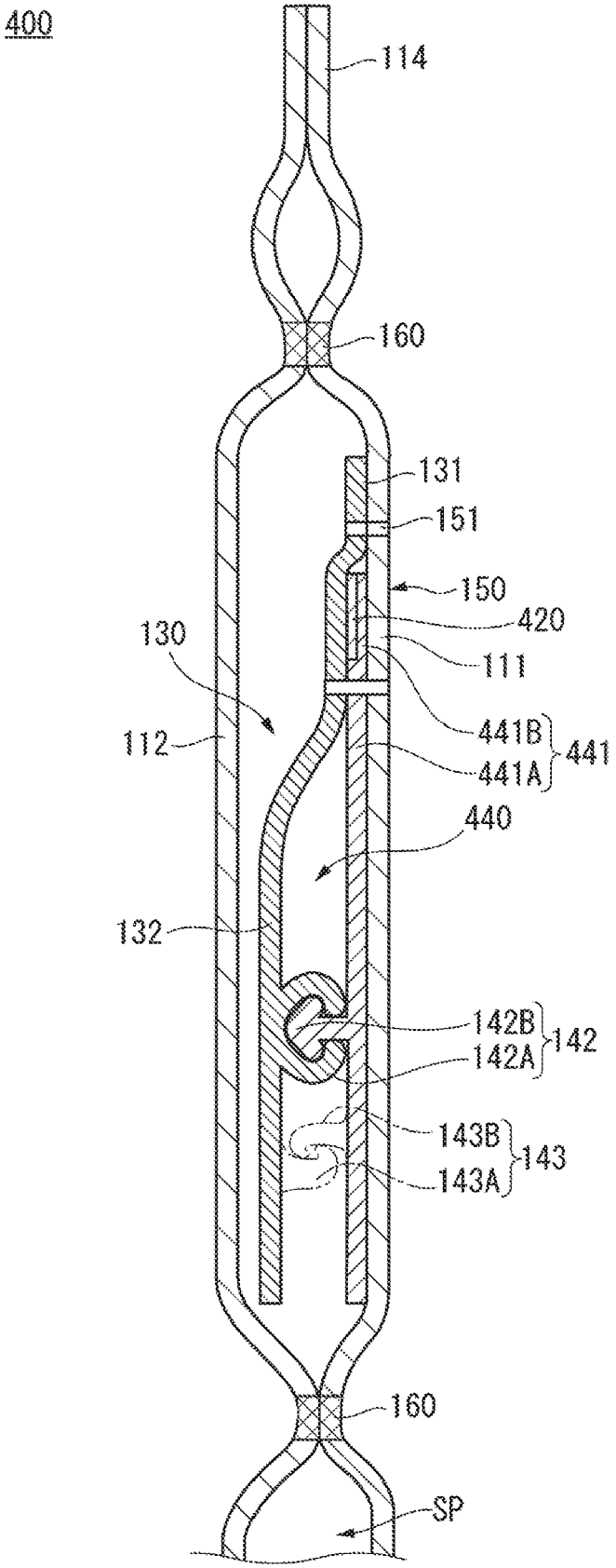
FIG. 20 is a cross sectional view of the bag taken along 20-20 line in FIG. 19.
Figure 21:
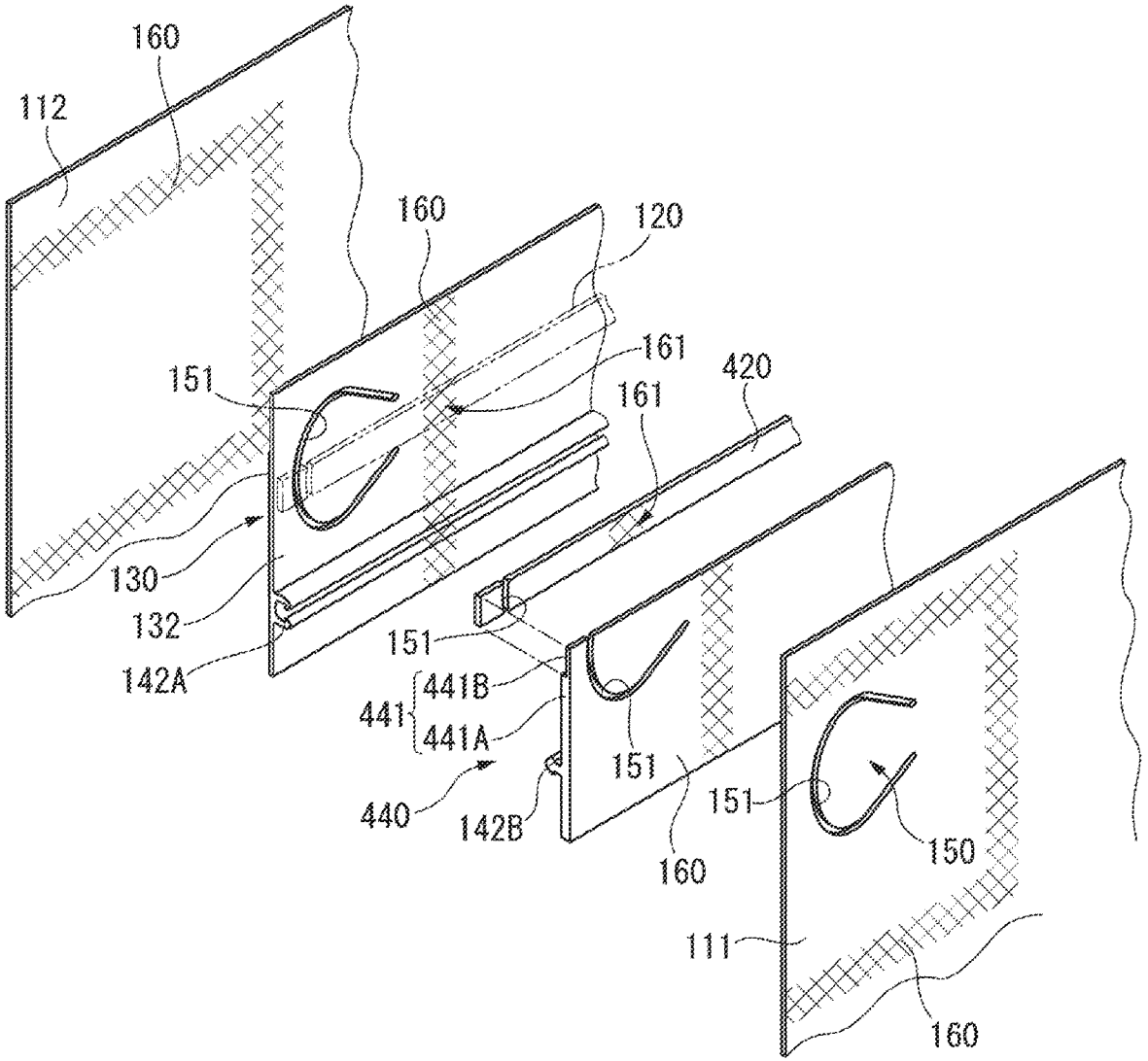
FIG. 21 is an exploded perspective view of a portion including a tab formed in the bag shown in FIG. 19.

Next, a fourth exemplary embodiment of the invention will be described below with reference to FIGS. 19 to 21. FIG. 19 is a front elevational view showing a bag according to the fourth exemplary embodiment. FIG. 20 is a cross sectional view of the bag shown in FIG. 19 taken along 20-20 line. FIG. 21 is an exploded perspective view of a portion including the tab formed in the bag shown in FIG. 19.

As shown in FIG. 19, a bag 400 includes the film 110, a tearing guide piece 420, the belt-shaped base 130, a zipper tape 440, the tab 150, and a surrounding seal area 160. It should be noted that the components of the bag 400 other than the below-described components related to the tearing guide piece 420 and the zipper tape 440 are the same as the components of the bag 100 according to the above-described first exemplary embodiment and duplicated explanation therefor will be omitted herein.

The tearing guide piece 420 is an elongated member extending along the top portion 102 of the bag 100. As shown in FIG. 20, the tearing guide piece 420 is bonded to a thin portion 441B of a later-described opposite base 441, and the thin portion 441B is bonded to the first area 111 of the film 110 at a side opposite the tearing guide piece 420. In other words, the tearing guide piece 420 is indirectly bonded to the first area 111 of the film 110 through the opposite base 441 (the thin portion 441B in the illustrated example). In the same manner as the first exemplary embodiment, a user can pinch the tearing guide piece 420 at the tab 150. The user can easily form an opening in the bag 400 by pulling the tearing guide piece 420 together with the thin portion 441B starting from the tab 150 and by tearing the film 110 with the tearing guide piece 420.

The tearing guide piece 420 in the fourth exemplary embodiment is cut together with the film 110 of the first area 111 and the thin portion 441B of the opposite base 441 at the cut portion 421 near an end of the tearing guide piece 420 opposite the tab 150. The cut portion 421 thus defines an end point of cutting of the film 110 and the thin portion 441B by the tearing guide piece 120, so that the tearing guide piece 420 can be easily removed after forming an opening in the bag 400. It should be noted that the cut portion 421 is not requisite in the invention as in the first exemplary embodiment. The cross sectional profile of the tearing guide piece 420, which is rectangular in the illustrated example, may be designed otherwise (e.g. triangular and semi-circular). Alternatively, the tearing guide piece 420 may be a string having an irregular cross sectional profile in the longitudinal direction.

As shown in FIG. 20, the zipper tape 440 includes the tape base 132 as a part of the belt-shaped base 130, an opposite base 441 opposite the tape base 132, and the engagement portion 142. These components of the zipper tape 440 are also elongated members extending along the top portion 102 of the bag 100 in the same manner as the tearing guide piece 420 and the belt-shaped base 130. The opposite base 441, which is disposed opposite the tape base 132, is bonded to the first area 111 of the film 110. The opposite base 441 includes a body 441A that is widened widthwise (as compared with the opposite base 141 in the example shown in FIG. 3) toward the top portion 102 of the bag 400 and provided with the male portion 142B of the engagement portion 142 protruding therefrom, and the thin portion 441B provided at an end of the body 441A in the width direction. As described above, the thin portion 441B is interposed between the tearing guide piece 420 and the first area 111 of the film 110. It should be noted that the engagement portion 142 and the hook-shaped engagement portion 143 have the same arrangements as those of the example shown in FIG. 3.

With the above arrangement, the cut portion 151 defining the tab 150 of the fourth exemplary embodiment penetrates through the opposite base 441 in addition to the first area 111 of the film 110, the tearing guide piece 120, and the belt-shaped base 130. Further, as shown in FIG. 21, at the intersection 161 defined at a part of the surrounding seal area 160 intersecting the tearing guide piece 420 in the width direction, adjacent ones of the first area 111 of the film 110, the thin portion 441B of the opposite base 441, the tearing guide piece 420, the belt-shaped base 130, and the second area 112 of the film 110 are mutually bonded.

The tab 150 and the surrounding seal area 160 provided in the fourth exemplary embodiment offer the same effects as those in the above-described first exemplary embodiment. Specifically, the formation of the tab 150 provides a start point for a user to pull the tearing guide piece 420 and facilitates creation of the opening in the bag 400. Further, the surrounding seal area 160 spatially isolates the space defined in an area surrounding the tab 150 and located between the first area 111 and the second area 112 of the film 110 from the containable space SP, so that the sealability of the containable space SP can be kept even when the tab 150 is provided.

In addition, the tearing guide piece 420, which is bonded to the thin portion 441B of the elongated opposite base 441 in the fourth exemplary embodiment, is guided by a step defined between the body 441A and the thin portion 441B of the opposite base 441 when being pulled, thereby further facilitating the creation of the opening of the bag 400 using the tearing guide piece 420. It should be noted that the same effect can be achieved by forming a projection extending along the tearing guide piece 420 in place of (or in addition to) the thin portion 441B.

It should be noted that the fourth exemplary embodiment is combinable with the second exemplary embodiment. Specifically, an interfolded portion of the film may be provided to one or more of the side portions 101A, 101B and the bottom portion 103 of the bag 400 of the fourth exemplary embodiment including the tearing guide piece 420 and the zipper tape 440. Further, a holder (e.g. a through hole(s) and a handle) for the bag 400 may be provided in the fourth exemplary embodiment. In addition, the first to third modifications of the first exemplary embodiment and the modification of the second exemplary embodiment are also applicable in the same manner in the fourth exemplary embodiment.

Preferable exemplary embodiments of the invention have been described above with reference to attached drawings. However, the scope of the invention is not limited to the exemplary embodiments. It is obvious to those having an ordinary skill in the field of the art pertaining to the invention that various modifications and variations are possible within the technical idea recited in claim(s), and it should be understood that these modifications and variations are within the technical scope of the invention.

For instance, various configurations available to those skilled in the art are applicable to the tearing guide piece, the belt-shaped base, and the zipper tape in addition to the examples described in the above exemplary embodiments. With the use the above configurations, for instance, the cut portion defining the tab may penetrate through the tape base of the zipper tape or the like, in addition to the first area of the film, the tearing guide piece, and the belt-shaped base. Further, the first area of the film, the tearing guide piece, and the belt-shaped base are not necessarily directly bonded, but may be indirectly bonded through, for instance, a belt-shaped sheet. Further, a belt-shaped member (e.g. belt-shaped sheet) may be interposed between the belt-shaped base and the second area of the film.

The invention claimed is:

1. A bag comprising:

a film defining a containable space, the film comprising a first area and a second area both facing the containable space;

an elongated tearing guide piece directly or indirectly bonded to the first area;

an elongated belt-shaped base disposed between the tearing guide piece and the second area along the tearing guide piece;

an opposite base disposed along and opposite the belt-shaped base, the opposite base being bonded to the first area;

at least one pair of engagement portions protrudes from respective ones of the belt-shaped base and the opposite base;

a tab defined by a cut portion penetrating through the first area of the film, the tearing guide piece, and the belt-shaped base and not penetrating through the second area; and a surrounding seal area bonding the first area and the second area resulting in a non-sealed space in an area surrounding the tab, the non-sealed space located between the first area and the second area and spatially separated from the containable space, wherein the surrounding seal area intersects the tearing guide piece in a width direction, of the tearing guide piece at a boundary between the non-sealed space and the containable space to define an intersection rigidly bonding the belt-shaped base to the second area to cut the belt-shaped base when the belt-shaped base is pulled together with the tearing guide piece.

2. The bag according to claim 1, wherein the film defines the containable space by being folded and providing two side portions of the bag, the first area and the second area are mutually opposed across the containable space, and a bonding portion, at which ends of the film are bonded, is formed on the second area.

3. The bag according to claim 2, wherein the film comprises a portion interfolded toward the containable space at at least one of the side portions of the bag, and at least one of the first area and the second area defines the interfolded portion.

4. The bag according to claim 2, wherein at least one of side portions of the bag is formed by folding the film and the at least one of the side portions is spaced apart from a longitudinal end of the tearing guide piece and a longitudinal end of the belt-shaped base.

5. The bag according to claim 1, wherein the surrounding seal area is adjacent to an at least one side portion of the bag defined by folding the film, the surrounding seal area surrounding the tab in cooperation with the at least one of the side portions.

6. The bag according to claim 1, wherein the surrounding seal area surrounds the tab by itself.

7. The bag according to claim 1, wherein the tearing guide piece is bonded to the first area through the opposite base.

8. The bag according to claim 1, further comprising a cut portion formed at a position different from the tab, the cut portion penetrating through the first area of the film and the tearing guide piece without penetrating through the belt-shaped base.

9. The bag according to claim 1, wherein the belt-shaped base is disposed to separate the tearing guide piece from the second area.

10. A manufacturing method of the bag comprising:

transferring a film;

directly or indirectly bonding an elongated tearing guide piece and an elongated belt-shaped base overlaid on the tearing guide piece with the film;

forming a cut portion to form a tab penetrating through the film, the tearing guide piece, and the belt-shaped base;

defining a containable space after forming of the cut portion, a first area bonded with the tearing guide piece and the belt-shaped base and facing the containable space, and a second area facing the containable space as well as the first area;

forming a first bonding portion at which both ends of the film in the width direction are bonded;

forming a second bonding portion extending in the width direction of the film;

cutting the film in the width direction at a part near the second bonding portion; and forming a surrounding seal area intersecting the tearing guide piece in the width direction, the surrounding seal area bonding the first area and the second area resulting in a non-sealed area adjacent to the tab being spatially separated from the containable space, and wherein the bag manufactured is the bag of claim 1.

11. The manufacturing method of a bag according to claim 10, wherein, in forming the first area and the second area, the film is folded at least at two parts in the width direction, and the first bonding portion is formed in the second area.

12. The manufacturing method of a bag according to claim 10, further comprising integrally molding the tearing guide piece and the belt-shaped base.

13. The manufacturing method of a bag according to claim 10, further comprising:

forming a second cut portion at a position different from the tab, the second cut portion penetrating through the film and the tearing guide piece without penetrating through the belt-shaped base.

14. A manufacturing machine of the bag, comprising:

an elongated-member bonding unit configured to directly or indirectly bond an elongated tearing guide piece and an elongated belt-shaped base overlaid on the tearing guide piece with a film;

a tab former configured to form a cut portion to form a tab penetrating through the film, the tearing guide piece, and the belt-shaped base;

a bag former configured to define a containable space after forming of the cut portion, a first area bonded with the tearing guide piece and the belt-shaped base and facing the containable space, and a second area facing the containable space as well as the first area;

a first bonding-portion former configured to form a first bonding portion at which both ends of the film in the width direction are bonded;

a second bonding-portion former configured to form a second bonding portion extending in the width direction of the film;

a cutter configured to cut the film in the width direction at a part near the second bonding portion; and a third bonding-portion former configured to form a surrounding seal area intersecting the tearing guide piece in the width direction, the surrounding seal area bonding the first area and the second area to define a non-sealed area surrounding the tab and wherein the bag manufactured is the bag of claim 1.

15. The manufacturing machine of a bag according to claim 14, wherein the bag former is configured to fold the film at least at two parts in the width direction, and the first bonding-portion former is configured to form the first bonding portion in the second area.

16. The manufacturing machine of a bag according to claim 14, further comprising a molding machine configured to integrally mold the tearing guide piece and the belt-shaped base.

17. The manufacturing machine of a bag according to claim 14, further comprising:

a cut-portion former configured to form a second cut portion at a position different from the tab, the second cut portion penetrating through the film and the tearing guide piece without penetrating through the belt-shaped base.

18. A bag comprising:

a film defining a containable space, the film comprising a first area and a second area both facing the containable space;

an elongated tearing guide piece directly or indirectly bonded to the first area;

an elongated belt-shaped base disposed between the tearing guide piece and the second area along the tearing guide piece, the belt-shaped base being bonded to the first area at both sides in a width direction of the tearing guide piece to separate the tearing guide piece from the second area and having a gap facing a surface of the tearing guide piece opposite to the first area;

a tab defined by a cut portion penetrating through the first area of the film, the tearing guide piece, and the belt-shaped base and not penetrating through the second area; and a surrounding seal area bonding the first area and the second area resulting in a non-sealed space in an area surrounding the tab, the non-sealed space located between the first area and the second area and spatially separated from the containable space, wherein the surrounding seal area intersects the tearing guide piece in the width direction, at a boundary between the non-sealed space and the containable space to define an intersection rigidly bonding the belt-shaped base to the second area to cut the belt-shaped base when the belt-shaped base is pulled together with the tearing guide piece.

19. A manufacturing method of the bag comprising:

transferring a film;

directly or indirectly bonding an elongated tearing guide piece and an elongated belt-shaped base overlaid on the tearing guide piece with the film;

forming a cut portion to form a tab penetrating through the film, the tearing guide piece, and the belt-shaped base;

defining a containable space after forming of the cut portion, a first area bonded with the tearing guide piece and the belt-shaped base and facing the containable space, and a second area facing the containable space as well as the first area;

forming a first bonding portion at which both ends of the film in the width direction are bonded;

forming a second bonding portion extending in the width direction of the film;

cutting the film in the width direction at a part near the second bonding portion; and forming a surrounding seal area intersecting the tearing guide piece in the width direction, the surrounding seal area bonding the first area and the second area resulting in a non-sealed area adjacent to the tab being spatially separated from the containable space, and wherein the bag manufactured is the bag of claim 18.

20. A manufacturing machine of the bag, comprising:

an elongated-member bonding unit configured to directly or indirectly bond an elongated tearing guide piece and an elongated belt-shaped base overlaid on the tearing guide piece with a film;

a tab former configured to form a cut portion to form a tab penetrating through the film, the tearing guide piece, and the belt-shaped base;

a bag former configured to define a containable space after forming of the cut portion, a first area bonded with the tearing guide piece and the belt-shaped base and facing the containable space, and a second area facing the containable space as well as the first area;

a first bonding-portion former configured to form a first bonding portion at which both ends of the film in the width direction are bonded;

a second bonding-portion former configured to form a second bonding portion extending in the width direction of the film;

a cutter configured to cut the film in the width direction at a part near the second bonding portion; and a third bonding-portion former configured to form a surrounding seal area intersecting the tearing guide piece in the width direction, the surrounding seal area bonding the first area and the second area to define a non-sealed area surrounding the tab and wherein the bag manufactured is the bag of claim 18.

* * * * *